US010159350B2

(12) United States Patent
Igarashi et al.

(10) Patent No.: US 10,159,350 B2
(45) Date of Patent: Dec. 25, 2018

(54) CHAIR

(71) Applicant: OKAMURA CORPORATION, Kanagawa (JP)

(72) Inventors: Ryo Igarashi, Yokohama (JP); Hiroshi Masunaga, Yokohama (JP)

(73) Assignee: Okamura Corporation, Kanagawa (JP)

( * ) Notice: Subject to any disclaimer, the term of this patent is extended or adjusted under 35 U.S.C. 154(b) by 129 days.

(21) Appl. No.: 14/896,351

(22) PCT Filed: Jun. 6, 2014

(86) PCT No.: PCT/JP2014/065083
§ 371 (c)(1),
(2) Date: Dec. 4, 2015

(87) PCT Pub. No.: WO2014/196626
PCT Pub. Date: Dec. 11, 2014

(65) Prior Publication Data

US 2016/0120320 A1 May 5, 2016

(30) Foreign Application Priority Data

Jun. 7, 2013 (JP) ..... 2013-121270
Jun. 7, 2013 (JP) ..... 2013-121271

(51) Int. Cl.
*A47C 7/02* (2006.01)
*A47C 7/14* (2006.01)
(Continued)

(52) U.S. Cl.
CPC ..... *A47C 7/14* (2013.01); *A47C 7/004* (2013.01); *A47C 7/029* (2018.08); *A47C 7/185* (2013.01)

(58) Field of Classification Search
CPC ..... A47C 1/03255; A47C 3/026; A47C 4/03; A47C 7/14; A47C 7/004; A47C 7/022;
(Continued)

(56) References Cited

U.S. PATENT DOCUMENTS 3,173,723 A * 3/1965 Hoven ..... A47C 3/18 297/451.1
4,368,917 A 1/1983 Urai
(Continued)

FOREIGN PATENT DOCUMENTS

AU 2013 202 879 A1 5/2013
CN 101415352 A 4/2009
(Continued)

OTHER PUBLICATIONS

Office Action dated Mar. 3, 2017 of the Chinese Patent Application No. 201480031950.9.
(Continued)

*Primary Examiner* — James M Ference
*Assistant Examiner* — Kyle J. Walraed-Sullivan
(74) *Attorney, Agent, or Firm* — Nixon Peabody LLP; Jeffrey L. Costellia

(57) ABSTRACT

A chair is provided in which a seat-receiving member is provided with outward flanges for regulating upward/downward displacement to support left and right lateral edges of a seat plate. Engaging grooves supported by the outward flanges are provided at the respective left and right lateral edges of the seat plate. Warpage allowable parts in which warpage deformation of the lateral edges is allowed without the upward displacement being regulated by the seat receiving member are provided in regions of the left and right lateral edges of the seat plate, in which the regions are located at a rear side from engagement parts between the engaging grooves and the outward flanges. With this con-
(Continued)

stitution, it is possible to prevent the seat plate from being detached from the seat-receiving member while ensuring that, when an user is seated, the sides of the buttocks of the user are reliably held, and thus improve the seating stability of a seat body.

12 Claims, 15 Drawing Sheets

(51) Int. Cl.
*A47C 7/18* (2006.01)
*A47C 7/00* (2006.01)

(58) Field of Classification Search
CPC .. A47C 7/185; A47C 7/16; A47C 7/02; A47C 7/282; A47C 7/46
See application file for complete search history.

(56) References Cited

U.S. PATENT DOCUMENTS 4,502,731 A * 3/1985 Snider ..... A47C 7/024 297/452.15
4,988,145 A * 1/1991 Engel ..... A47C 1/03255 297/300.4
5,887,951 A * 3/1999 Willingham ..... A47C 7/16 297/258.1
5,934,758 A * 8/1999 Ritch ..... A47C 7/14 24/297
6,193,313 B1 * 2/2001 Jonsson ..... A47C 1/023 297/284.1
6,224,160 B1 * 5/2001 Takeuchi ..... A47C 3/00 297/440.15
6,652,034 B1 * 11/2003 Schramm ..... A47C 7/185 297/452.29
8,590,978 B2 * 11/2013 Jaranson ..... B60N 2/643 297/218.1
2001/0038234 A1 * 11/2001 Drira ..... A47C 7/024 297/284.11
2002/0190559 A1 * 12/2002 Phillips ..... A47C 1/023 297/337
2004/0051362 A1 * 3/2004 Heidmann ..... A47C 1/03255 297/342
2008/0100119 A1 * 5/2008 Bock ..... A47C 1/023 297/445.1
2010/0314929 A1 * 12/2010 Hsu ..... A47C 7/022 297/452.48
2011/0062758 A1 * 3/2011 Wiese ..... A47C 1/023 297/284.8
2011/0210597 A1 * 9/2011 Takeuchi ..... B29C 44/1238 297/452.55
2011/0277246 A1 * 11/2011 Willingham ..... A47C 3/12 5/653
2012/0187741 A1 * 7/2012 Kumazawa ..... A47C 5/10 297/463.1
2012/0205948 A1 * 8/2012 Okuda ..... A47C 7/40 297/188.03
2013/0169017 A1 7/2013 Masunaga et al.
2013/0193738 A1 * 8/2013 Siekman ..... A47C 7/021 297/452.56
2013/0313875 A1 * 11/2013 Brncick ..... A47C 7/022 297/311
2014/0183924 A1 * 7/2014 Cvek ..... A47C 9/002 297/452.18
2015/0015042 A1 * 1/2015 Willingham ..... A47C 7/022 297/284.7
2016/0157615 A1 * 6/2016 Piretti ..... A47C 7/44 297/301.1
2016/0255958 A1 * 9/2016 Alvarez ..... A47C 7/20
2016/0255960 A1 * 9/2016 Piretti ..... A47C 5/06

FOREIGN PATENT DOCUMENTS

CN 101573061 A 11/2009
CN 102946762 A 2/2013
JP 2002-223886 A 8/2002
JP 2003135187 A 5/2003
JP 2004049654 A 2/2004
JP 3769491 B 4/2006
JP 3967150 B 8/2007
JP 4202687 B 12/2008
JP 2009-011741 A 1/2009
JP 4238122 B 3/2009
JP 2009-112729 A 5/2009
JP 2010505507 A 2/2010
JP 2010-094365 A 4/2010
JP 4448487 B 4/2010
JP 4804619 B 11/2011
JP 2011-255070 A 12/2011
JP 4888965 B 2/2012
JP 2012-090786 A 5/2012
JP 2013-103090 A 5/2013
WO 2009/147249 A1 12/2009

OTHER PUBLICATIONS

Notice of Allowance dated Apr. 25, 2017 of Japanese Patent Application No. 2013-121270.
Notice of Allowance dated Apr. 25, 2017 of Japanese Patent Application No. 2013-121271.
PCT/JP2014/065083 International Search Report dated Jul. 29, 2014.
European Search Report dated Nov. 28, 2016, 6 pages.

* cited by examiner

CHAIR

CROSS-REFERENCE TO RELATED PATENT APPLICATION

The present application is a National Stage Application of International Application No. PCT/JP2014/065083 entitled "CHAIR" filed Jun. 6, 2014, which claims priority to Japanese Patent Application Numbers 2013-121270 filed Jun. 7, 2013, and Japanese Patent Application Numbers 2013-121271 filed Jun. 7, 2013 the contents of which are incorporated herein by reference in their entirety.

TECHNICAL FIELD

The present invention relates to a chair that improves seating stability of a seat body.

BACKGROUND ART

In conventional chairs used for business, etc., a seat plate that is a frame part of a seat body is supported on an upper end of a leg assembly via a seat receiving member such as a slide frame (e.g., see Patent Documents 1 to 3).

In the chairs described in Patent Documents 1 to 3, engaging grooves that extend in a forward/backward direction and have approximately U-shaped cross sections that are open upward or downward, and protrusion that are engaged with the engaging groove are provided between the seat receiving member and the seat plate. Also, upward/downward displacement of the seat plate relative to the seat receiving member is regulated by a separate displacement regulating means (fall prevention means).

In the case of these chairs, since the engaging grooves and the protrusions that are engaged with each other are provided with the displacement regulating means acting as a separate member, the number of components is increased, and a structure easily becomes complicated. For this reason, chairs improving these drawbacks have currently been devised (e.g., see Patent Documents 4 and 5).

In the chairs described in Patent Documents 4 and 5, engaging grooves that extend in a forward/backward direction and have approximately U-shaped cross sections that are open to an inner side in a width direction are provided at both left and right edges of a seat plate, and flange parts respectively engaged with the left and right engaging grooves of the seat plate are provided at both left and right edges of a seat receiving member. Upward/downward displacement (falling off) of the seat plate relative to the seat receiving member is hindered by the engagement of the flange parts with the engaging grooves. In these chairs, the engaging grooves of the seat plate are provided at almost part of the seat plate in the forward/backward direction, and the upward/downward displacement of the seat plate is regulated at almost part of the seat plate in the forward/backward direction.

Also, in the chair described in Patent Document 5, from the viewpoint of moldability and sitting comfort, the seat plate is formed of a synthetic resin having flexibility.

On the other hand, a chair baseplate (seat plate) is disclosed in Patent Document 6, which has a frame part surrounding the periphery of a pressure receiving part and numerous protrusions defining numerous meshes at the pressure receiving part and in which the meshes are open.

A chair baseplate (backrest) is disclosed in Patent Documents 7 and 8, in which slit-like openings are linearly arranged in a longitudinal direction and are arranged in a zigzag form in a width direction by shifting a position of the longitudinal direction.

A chair baseplate (backrest) is disclosed in Patent Document 9, in which numerous rhombic openings that extend vertically are arranged vertically and horizontally.

On the other hand, as a chair in which a seat body including a seat plate and a seating body such as a cushion is supported on a seat receiving structure supported on a leg body to be movable backward and forward, for example, the chairs disclosed in Patent Documents 1 to 5 and 10 described above are known.

In the chairs of this field, both left and right lateral portions of the seat plate are supported to be slidable in a forward/backward direction at both left and right lateral portions of the seat receiving structure supported on the leg body. This structure is intended to provide a comfortable chair in which, as a position of a front end of the seat plate can be variously adjusted according to a size of the body of an user, a back of a knee of the user is properly supported from a lower side by the seat body, and the user does not get tired even when seated for a long time.

CITATION LIST

Patent Document

[Patent Document 1] Japanese Patent No. 4804619
[Patent Document 2] Japanese Patent No. 3769491
[Patent Document 3] Japanese Patent No. 4202687
[Patent Document 4] Japanese Unexamined Patent Application, First Publication No. 2002-223886
[Patent Document 5] Japanese Patent No. 3967150
[Patent Document 6] Japanese Patent No. 4238122
[Patent Document 7] Japanese Patent No. 4448487
[Patent Document 8] Japanese Patent No. 4888965
[Patent Document 9] Japanese Unexamined Patent Application, First Publication No. 2009-112729
[Patent Document 10] Japanese Unexamined Patent Application, First Publication No. 2010-94365

SUMMARY OF INVENTION

Technical Problem

In this type of chair, to improve seating stability of the user, the seat plate is preferably deformed and bent downward such that buttocks of the user are surrounded from the left and right directions (i.e., are not displaced in the left or right direction) when the user sits on the seat body. In this respect, the chair in which the seat plate is formed of the easily bent synthetic resin and which is described in Patent Document 5 is preferred, but there is additional room for improvement in the following respects.

In the chair described in Patent Document 5, the upward/downward displacement of the seat plate is regulated by the seat receiving member at almost part of the lateral edges of the seat plate in the forward/backward direction. For this reason, although an almost central region of the seat plate in the forward/backward direction is bent and deformed downward when the user sits on the seat body, an upward/downward relative position at opposite lateral portions of the buttocks of the user on the seat plate is merely slightly elevated compared to the central region. For this reason, it is difficult to say that it is possible to properly exert an effect of preventing the displacement in the buttocks of the user.

The present invention is intended to provide a chair capable of holding sides of buttocks of the user reliably to improve seating stability of a seat body when the user is seated while preventing a seat plate from being separated from a seat receiving member.

Also, in Patent Document 6, since the protrusions are provided to continue vertically and horizontally, the baseplate is hardly bent although the openings are in a group.

In addition, in Patent Documents 7 and 8, since frame parts surrounding the openings are alternately arranged in the width direction, bending that opens the openings in the width direction is promoted, but strengths of the openings should be maintained by the frame parts remaining at a baseplate main body, which easily deteriorate over time.

Also, in Patent Document 9, since strengths of the openings are maintained by frame parts remaining at a baseplate main body, these easily deteriorate over time.

On the other hand, in the chair in which the seat body is designed to be movable backward and forward, both of the left and right lateral portions of the seat plate are supported on both of the left and right lateral portions of the seat receiving structure in a wide range in the forward/backward direction. For this reason, a region located at an inner side from both of the left and right lateral portions of the seat plate tends to be bent downward. On the other hand, a lower surface of the seat plate is usually formed with lattice-like ribs in consideration of the strength. Therefore, bending of the seat plate has to be locally generated in the region surrounded by the ribs, and it is difficult to generate bending by which the entire seat plate is gently deformed.

Also, in terms of a structure in which the seat plate slides relative to the seat receiving structure in the forward and backward directions, a space is inevitably generated between the two, and preventing fingers of the user from entering this space should also be considered. It is possible to deal with this matter only by providing ribs extending in a leftward/rightward direction as disclosed in Patent Document 10, but the seat plate is hindered from being bent by the leftward/rightward ribs.

The present invention has been made by considering the above circumstances and provides a chair baseplate used for a load support member of a chair and a chair using the same, which are provided such that the chair baseplate is easily bent in a specific direction while a sense of rigidity of the chair baseplate is secured.

Solution to Problem

To achieve the object, a chair according to the present invention employs the following constitutions.

In the chair according to the present invention, a seat plate forming a frame part of a seat body is supported on a leg assembly via a seat receiving member. In this chair, the seat receiving member includes constraining support parts that supports left and right lateral edges of the seat plate and regulates upward/downward displacement of the left and right lateral edges of the seat plate, and each of the left and right lateral edges of the seat plate includes a supported part that is supported by the constraining support part. Also, warpage allowable parts in which warpage deformation of the lateral edges is allowed without the upward displacement being regulated by the seat receiving member are provided in regions of the left and right lateral edges of the seat plate, in which the regions are located at a rear side from engagement parts between the constraining support parts and the supported parts.

Thereby, when an user sits on an upper portion of the seat body and a load of the user acts on the seat plate, the load is mainly supported on the seat receiving member at the left and right lateral edges of the seat plate, falling from the seat receiving member is regulated by engagement between the constraining support parts for the seat receiving member and the supported parts for the seat plate. Also, when the load of the user acts on regions at a rear side from the engagement parts between the constraining support parts and the supported parts, the left and right warpage allowable parts of the regions at the rear side are deformed to be warped upward, and the left and right buttocks of the user are held from the sides.

A displacement regulator by which the upward/downward displacement is regulated between the seat plate and the seat receiving member is preferably provided in an approximately intermediate region between the left and right warpage allowable parts of the seat plate.

In this case, when the side of the rear edges of the seat plate is made to be displaced in an upward/downward direction by a change in seating posture of the user, such displacement is regulated by a displacement regulator, and a forward/backward tilt of the seat plate is suppressed. Also, in comparison with the case in which upward/downward displacement of the seat plate is regulated only by engagement between the constraining support parts for the seat receiving member and the supported parts for the seat plate, a distance between the regions in which the upward/downward displacement on the seat plate is regulated is reduced. For this reason, unsteadiness of the seat plate 13 can be more effectively suppressed.

Also, the seat receiving member preferably includes downward displacement regulating surfaces that are disposed to be able to come in contact with lower surfaces in regions of the seat plate which are located at a rear side from the supported parts.

In this case, even when the load disproportionately acts on a portion of the seat plate in the vicinity of the rear edge of the seat plate due to a change in the seating posture of the user, partial sagging of the rear edge of the seat plate can be suppressed by the downward displacement regulating surfaces.

One of the constraining support part and the supported part may be formed by an engaging groove that extends out in a forward/backward direction and is open to the left or right, and the other of the constraining support part and the supported part may be formed by a protrusion engaged with the engaging groove.

In this case, as the protrusions are made to be engaged with the engaging grooves in the forward/backward direction, the constraining support parts and the supported part can be easily assembled.

Further, the engaging groove and the protrusion may be configured to be slidable in the forward/backward direction, and the position of the seat plate may be made adjustable relative to the seat receiving member via the engaging groove and the protrusion in the forward/backward direction.

In this case, the seat plate can be adjusted to an arbitrary position for the seat receiving member in the forward/backward direction using the engaging grooves and the protrusions. Also, when the seat plate is adjusted to either the front or rear position, the upward/downward displacement of the seat plate can be regulated by the engagement between the engaging grooves and protrusions.

The warpage allowable parts of the seat plate may include a bending promotion structure that facilitates bending deformation in a surface direction.

In this case, when the load of the user acts on the regions of the seat plate which are located at the rear side from the supported parts, the warpage allowable parts easily undergo the warpage deformation.

Also, the bending promotion structure is more preferably a structure that has directivity reducing leftward/rightward flexural rigidity while maintaining forward/backward rigidity of the seat plate.

In this case, when the load of the user acts on the regions of the seat plate which are located at the rear side from the supported part, great deformation of the warpage allowable parts in the forward/backward direction is not incurred, and the flexural (warpage) deformation in the leftward and rightward directions is promoted.

The bending promotion structure may include a plurality of reinforcement ribs that are provided for the seat plate in the forward/backward direction, and a plurality of thinning holes that are intermittently provided in a general surface between the neighboring reinforcement ribs of the seat plate.

In this case, the forward/backward rigidity of the warpage allowable parts is maintained by the plurality of ribs, and the flexural rigidity in the leftward and rightward directions is kept low by the plurality of thinning holes between the neighboring ribs.

Further, to achieve the object, the present invention employs the following means.

That is, in a structure of a chair baseplate according to the present invention which is employed for a load support member of the chair, the chair baseplate supported in a proper place of the chair has: a plurality of protrusions that are formed in a reverse side of a baseplate main body which is the opposite side of an user, extend in directions intersecting leftward and rightward directions, and are arranged in the leftward and rightward directions independently of one another; and an outer circumferential wall that is formed at an outer circumferential portion of the reverse side of the baseplate main body and surrounds the plurality of protrusions.

According to this constitution, bending is suppressed by the plurality of protrusions in a direction in which the protrusions extend in the chair baseplate, and a sense of rigidity of the seat body or the backrest is secured. On the other hand, the plurality of protrusions are put into an unconnected state in which they are independent of one another. Thereby, it is possible to easily bend the chair baseplate in the directions (leftward and rightward directions) in which the plurality of protrusions are arranged. Due to the bending of the chair baseplate, it is possible to hold the body of the user to be enclosed from the leftward and rightward directions, and support the seating posture. Also, strength and rigidity of the entire chair baseplate can be properly secured by the outer circumferential wall.

The aforementioned load support member is a concept that includes a lumbar support and a headrest in addition to the seat body and the backrest.

The chair baseplate according to the present invention may have easily deformable parts that avoid the plurality of protrusions to form a bending promoter in the baseplate main body.

In this case, it is possible to more easily bend the aimed regions in the leftward and rightward directions by the easily deformable parts while securing the sense of rigidity in the extending direction of the plurality of protrusions due to the plurality of protrusions, and holdability can be further improved. Also, since the protrusions are left around the bending promoter, it is possible to secure durability of the easily deformable parts.

The chair baseplate according to the present invention may include a baseplate receiving structure configured to support the chair baseplate in the proper place of the chair, and the baseplate receiving structure may be provided to cover at least some protrusion groups of the plurality of protrusions, may be separated from tip edges of the protrusions before a load corresponding to a body pressure of the user is applied to the chair baseplate, and may come in contact with the tip edges of the protrusions when the load is applied.

In this case, without providing a separate cover, the reinforcement structures such as the protrusions are hardly visible from the outside due to the baseplate receiving structure, and it is possible to improve an appearance while reducing costs.

Also, when the user is seated, the tip edges of the protrusions are brought into contact with the baseplate receiving structure by the body pressure of the user. Thereby, the excessive deformation of the chair baseplate can be suppressed, and the bending of the chair baseplate can be controlled by setting of the protrusion coming in contact with the baseplate receiving structure.

The chair baseplate according to the present invention may be supported on the baseplate receiving structure to be movable in a direction in which the protrusions extend.

In this case, when the chair baseplate is moved, although the protrusions abut the baseplate receiving structure, the chair baseplate can be smoothly moved along the protrusions.

In addition, a chair according to the present invention includes a leg body, a seat receiving structure supported on the leg body, and a seat plate supported on the seat receiving structure, in which the seat plate has a plurality of protrusions that are formed on a lower surface of a seat plate main body to extend in a forward/backward direction and are arranged left and right independently of one another, and an outer circumferential wall that is formed at an outer circumferential portion of the lower surface of the seat plate main body to surround the plurality of protrusions. Further, a rear portion of the outer circumferential wall is formed with a cutout part that avoids a backrest support member, and rear ends of the at least some protrusion groups of the plurality of protrusions face the cutout part.

According to this constitution, the bending in the direction in which the protrusions extend in the seat plate is suppressed by the plurality of protrusions, and the sense of rigidity of the seat plate is secured while the plurality of protrusions are put into an unconnected state in which they are independent of one another. Thereby, it is possible to easily bend the seat plate in the directions (leftward and rightward directions) in which the plurality of protrusions are arranged. Due to the bending of the seat plate, it is possible to hold the body of the user to be enclosed from the leftward and rightward directions and support the seating posture. Also, the strength and rigidity of the entire seat plate can be properly secured by the outer circumferential wall, and the bendability can be secured in the leftward and rightward directions by the cutout part.

Also, the cutout part is formed at a rear portion of the outer circumferential wall that serves as a frame of the entire seat plate, and thereby the bendability, particularly of the rear portion, of the entire seat plate in the leftward and rightward directions can be improved. The rear ends of the plurality of ribs face the cutout part, and thereby the fingers of the user can be prevented from entering the cutout part.

Advantageous Effects of Invention

According to the present invention, the upward/downward displacement of the seat plate relative to the seat receiving member is regulated by the engagement between the constraining support parts for the seat receiving member and the supported parts for the seat plate, and the warpage allowable parts in the regions of the seat plate which are located at the rear side from the supported parts are warped and deformed upward when the load of the user acts on the seat plate. Thereby, the left and right buttocks of the user can be reliably held from the sides. For this reason, it is possible to further improve the seating stability of the seat body while preventing the falling of the seat plate of the chair.

Also, according to the present invention, in the chair using the chair baseplate employed for the load support member of the chair, it is possible to easily bend the chair baseplate in a specific direction while securing a sense of rigidity of the chair baseplate.

DESCRIPTION OF EMBODIMENTS

Hereinafter, embodiments of the present invention will be described with reference to the drawings. In the following description, a direction in which the front face of a person who sits on a chair in a normal posture is directed and in which an arrow FR in the figure points is referred to as "front" and a direction opposite to this direction is referred to as "rear". Also, in regard to "above", "below", "left" and "right", a direction in which an arrow UP in the figure points an upper side of the person who sits on the chair in the normal posture is referred to as "above", a direction opposite to this direction is referred to as "below", a direction in which an arrow LH in the figure points to the left of the person who sits on the chair 1 in the normal posture is referred to as "left" and a direction opposite to this direction is referred to as "right".

First, a first embodiment shown in FIGS. 1 to 12 will be described.

Figure 1:
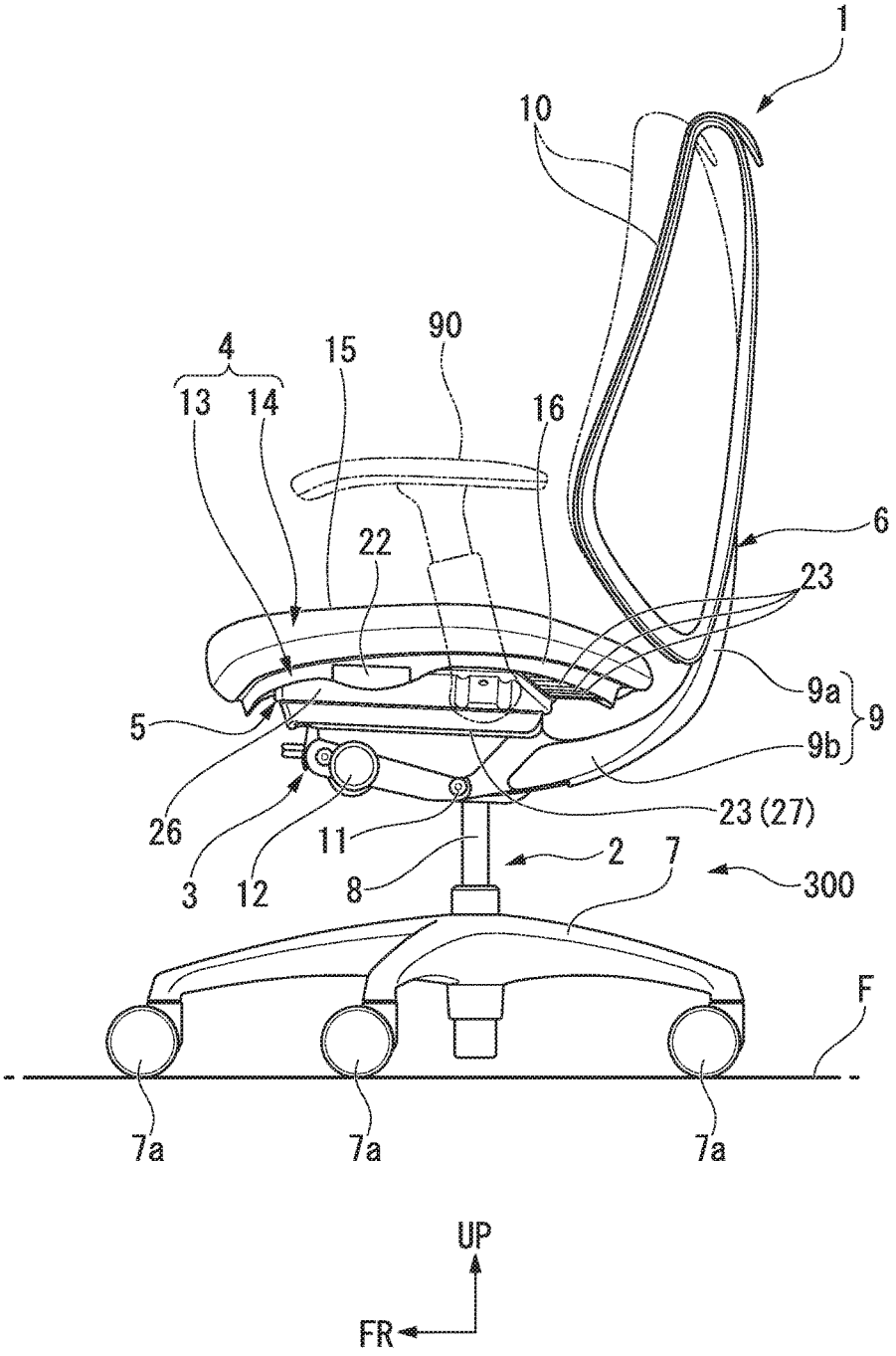
FIG. 1 is a side view of a chair in a first embodiment of the present invention.
Figure 2:
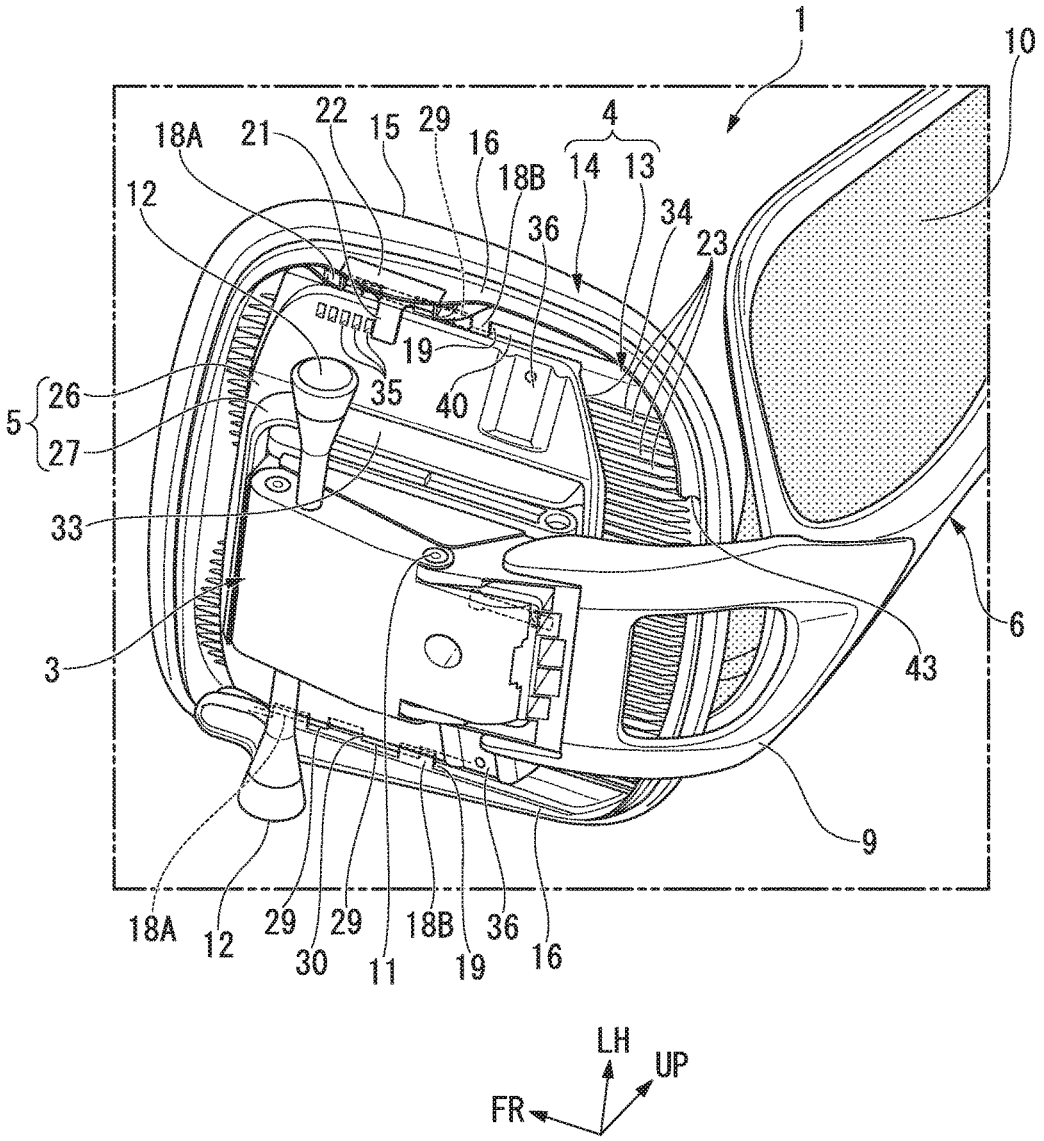
FIG. 2 is a perspective view in a state in which a leg assembly of the chair in the first embodiment of the present invention is demounted.

FIG. 1 is a side view illustrating an overall constitution of a chair 1 of this embodiment, and FIG. 2 is a perspective view of the chair 1 from which some components are demounted when viewed from an oblique lower side.

As shown in these figures, the chair 1 of this embodiment is equipped with a leg assembly 2 that is placed on a floor F, a forked support base 3 that is installed on an upper end of the leg assembly 2, a seat body 4 on which an user sits, a seat receiving member (seat receiving structure, baseplate receiving structure) 5 that is mounted on an upper surface of the support base 3 to support the seat body 4, and a backrest part 6 that extends from the support base 3 to a rear upper side and supports the back of the user who sits on the seat body 4.

The leg assembly 2 is equipped with a multi-branch leg 7 with casters 7*a*, and a leg column 8 that is erected from the center of the multi-branch leg 7 and has a built-in gas spring that is an elevating mechanism. The support base 3 is rotatably mounted on an upper end of the leg column 8 in a horizontal direction. An elevation adjusting mechanism of the leg column 8 and a tilt adjusting mechanism of the backrest part 6 are housed in the support base 3. The backrest part 6 is equipped with a backrest support frame (backrest support member) 9 having approximately an L shape in a side view, and a backrest main body 10 that is mounted on a front face of a rear upper portion of the backrest support frame 9 and directly supports the back of the user who sits on the seat body 4. Also, a front lower end of the backrest support frame 9 is coupled to the tilt adjusting mechanism in the support base 3. In the present embodiment, a structure including the multi-branch leg 7, the leg column 8, the support base 3, and the backrest support member 9 is referred to as a leg body 300.

In FIGS. 1 and 2, a reference sign 11 indicates a tilting shaft of the backrest support frame 9 on the support base 3, and a reference sign 12 indicates an operation knob of the tilt adjusting mechanism which protrudes from a side of the support base 3. Also, a reference sign 90 in FIG. 1 indicates a pair of left and right armrests as additional components that are mounted on both left and right lower surfaces of the seat body 4. Posts of the armrests 90 are supported at both left and right sides of a rear portion of the seat receiving member 5.

The backrest main body 10 has a constitution in which a mesh fabric is tightly stretched, for instance, in a front opening of a frame-shaped backrest frame. A rear side of a central lower portion of the backrest frame faces and overlaps a front side of a standing part 9*a* of the backrest support frame 9, and these are integrally fastened.

The backrest support frame 9 integrally has the standing part 9*a* disposed at a lower rear side of the backrest main body 10, and a pair of left and right forward arm parts 9*b* that branch off to the left and right at a lower side of the standing part 9*a* and are curved and extended forward. Front portions of the left and right forward arm parts 9*b* are integrally connected at a rear lower side of the seat body 4 via a cross part 9*c*. Front ends of the forward arm parts 9*b* are properly supported on a rear portion of the support base 3. The backrest part 6 (the backrest support frame 9 and the backrest main body 10) may be tilted back and forth by an operation of the tilt adjusting mechanism or be stopped at a desired backward tilting position.

Figure 3:
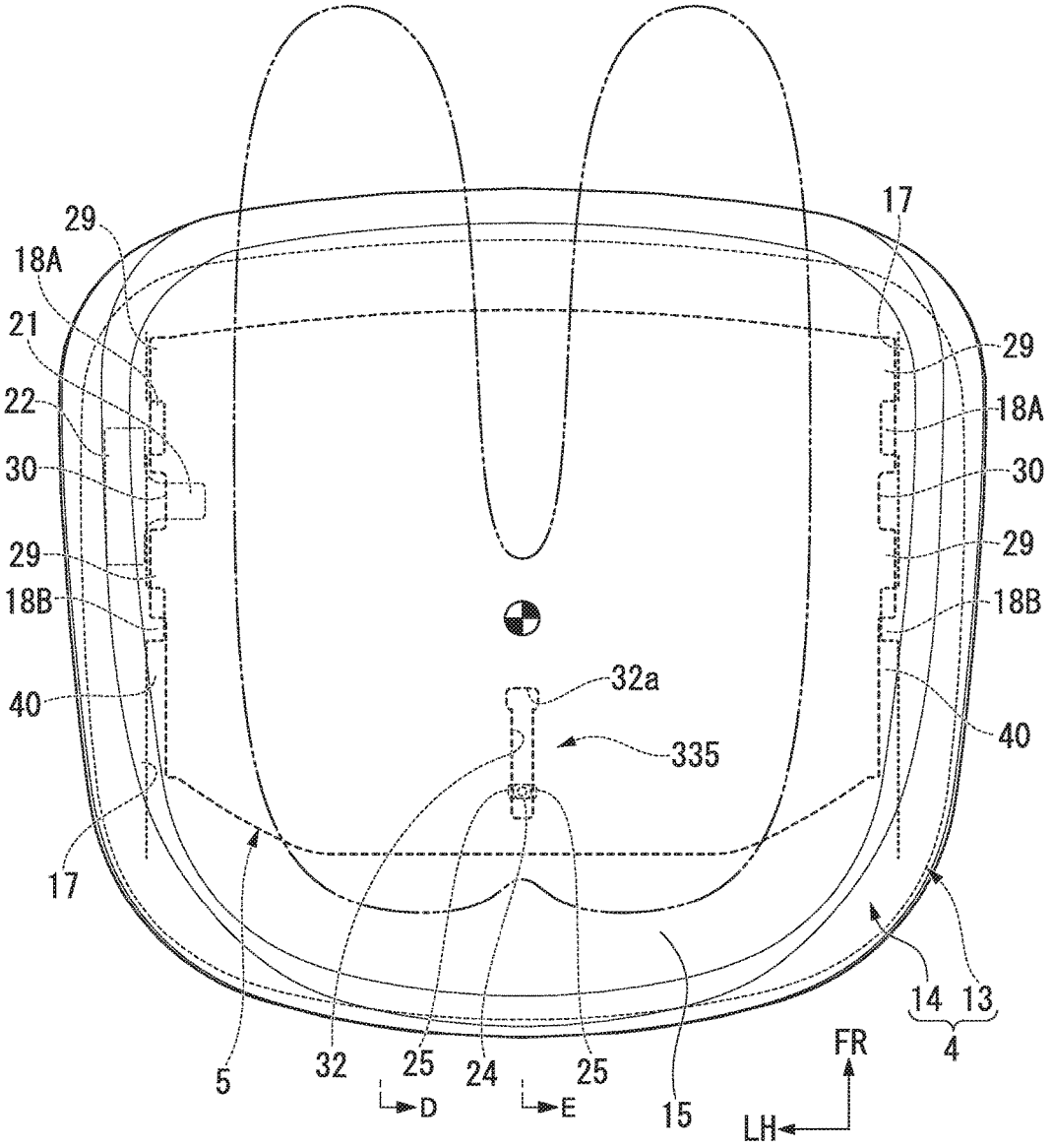
FIG. 3 is a top view of a seat body of the chair in the first embodiment of the present invention.
Figure 4:
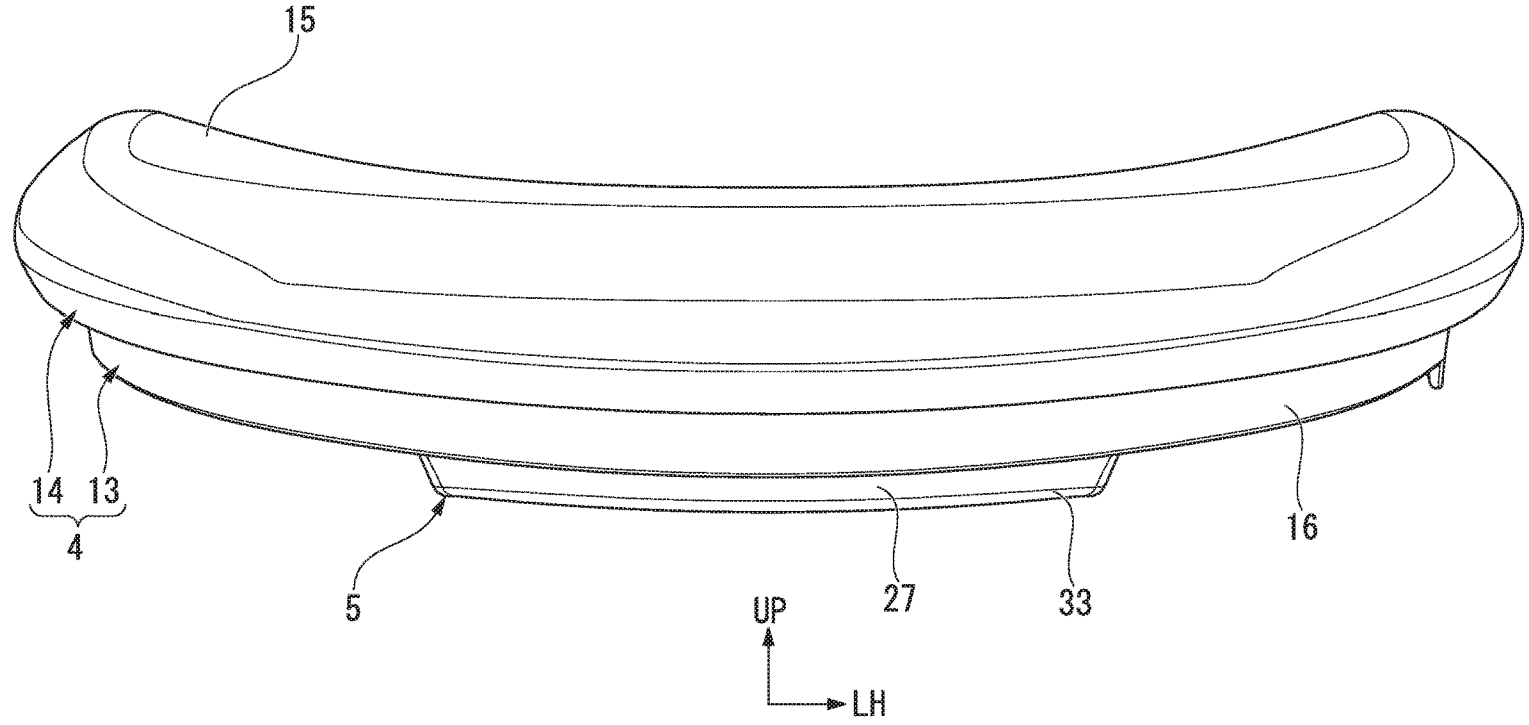
FIG. 4 is a front view of the seat body and seat receiving member of the chair in the first embodiment of the present invention.
Figure 5:
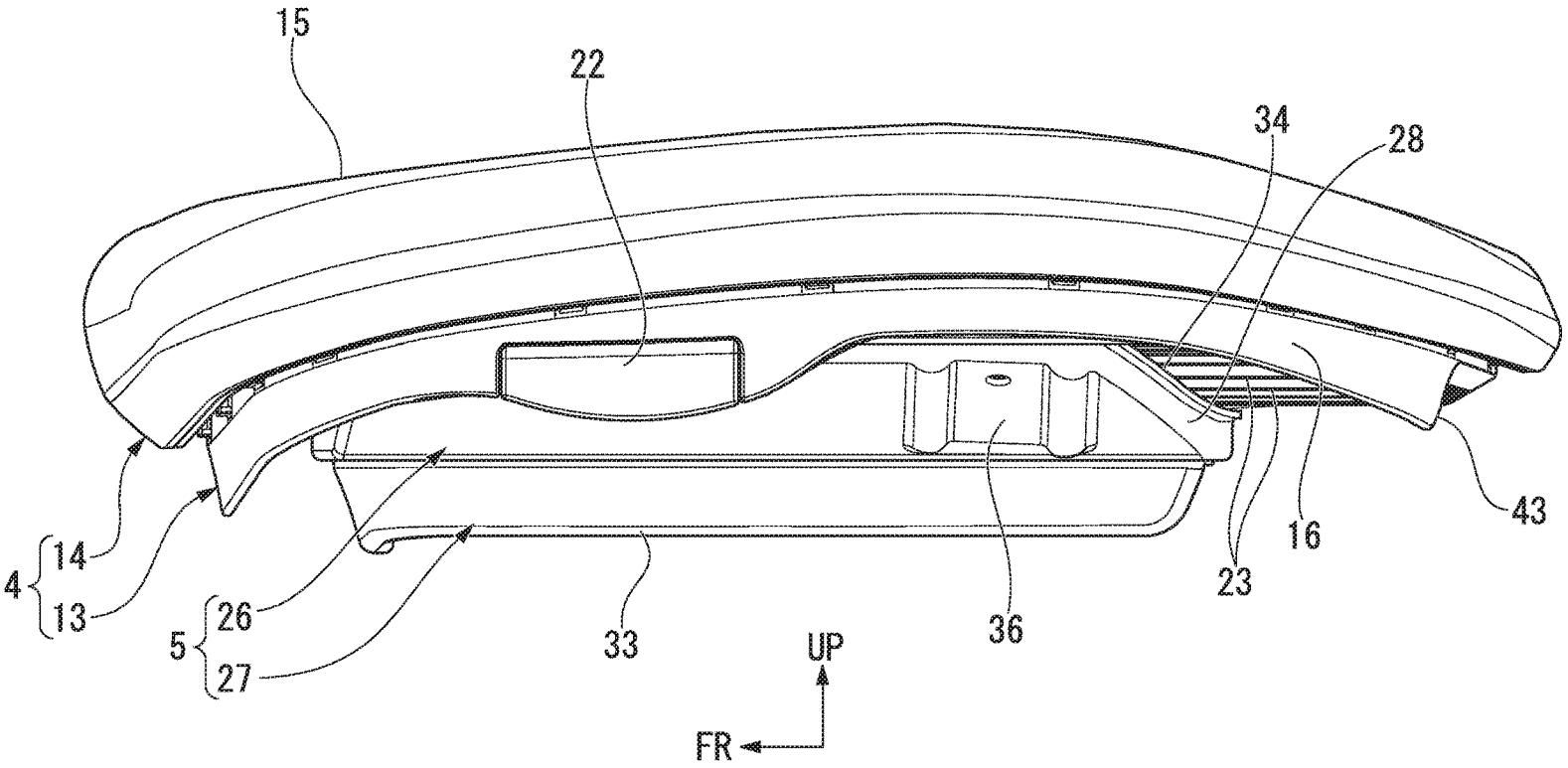
FIG. 5 is a left side view of the seat body and seat receiving member of the chair in the first embodiment of the present invention.

FIGS. 3, 4 and 5 are a top view, a front view, and a left side view of the seat body 4 and the seat receiving member 5, and FIGS. 6 to 11 are sectional views of the seat body 4 and the seat receiving member 5.

The seat body 4 is equipped with a seat plate 13 forming a frame part (chair baseplate), and a seat 14 mounted on an upper portion of the seat plate 13. Although not illustrated in detail, the seat 14 is equipped with a seat frame (not illustrated) that is mounted on an outer circumferential edge of the seat plate 13, a cushion material (not illustrated) that is installed on an upper surface of the seat plate 13 and is formed of a urethane foam or the like, and a seat sheath material 15 that is tightly stretched on the seat frame and covers an upper side of the cushion material. The seat 14 may be integrally provided at an upper portion of the seat plate 13.

Figure 6:
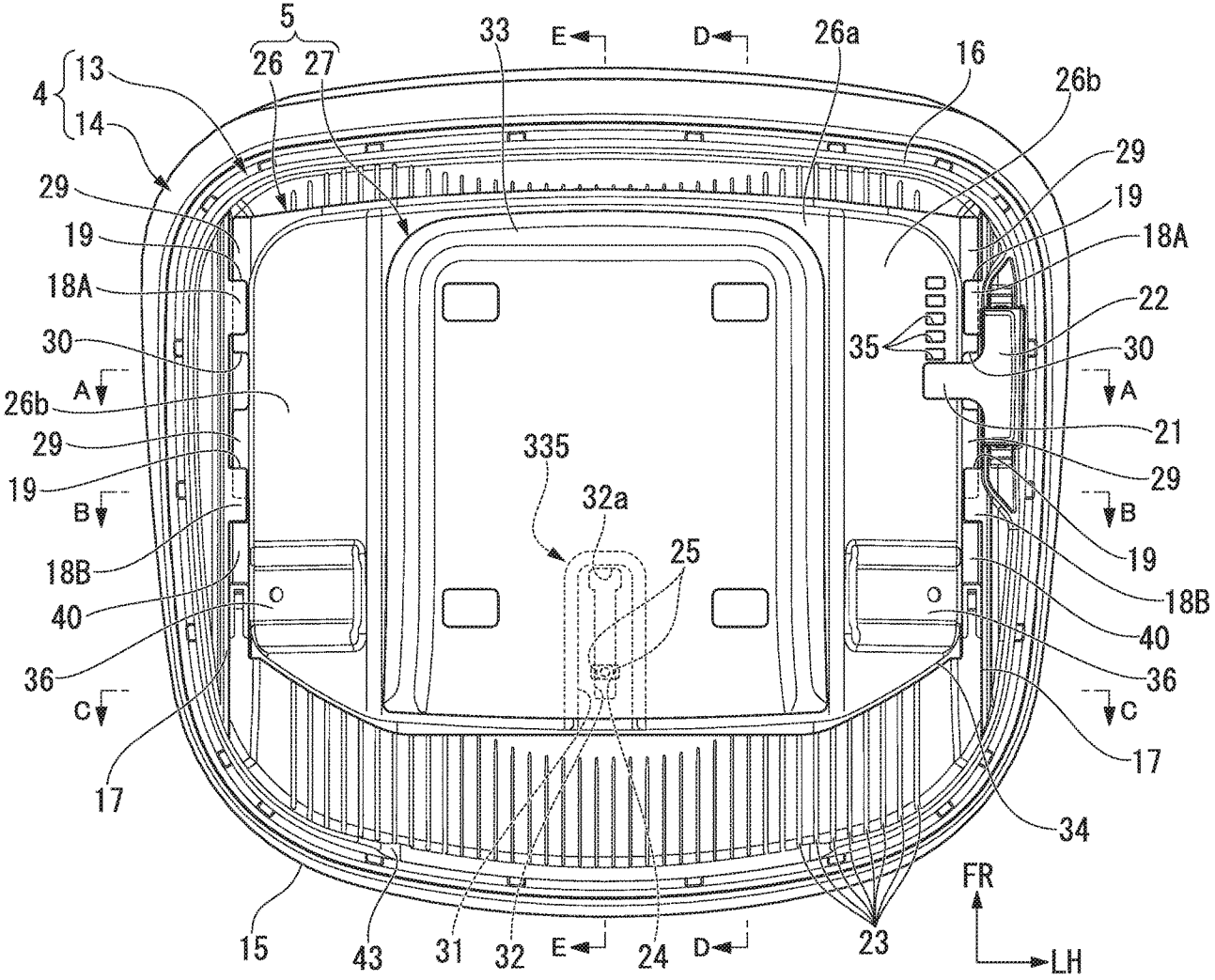
FIG. 6 is a bottom view of the seat body and seat receiving member of the chair in the first embodiment of the present invention.

The seat plate 13 is formed of a synthetic resin having elasticity, and as shown in FIGS. 2, 3 and 6, has an approximately rectangular shape in which corners are rounded in a top view. Left and right lateral sides of the seat plate 13 are slightly narrowed backward, and arcs of the corner portions at a rear side of the seat plate 13 are adapted to be greater than those of the corner portions at a front side of the seat plate 13.

Figure 7:
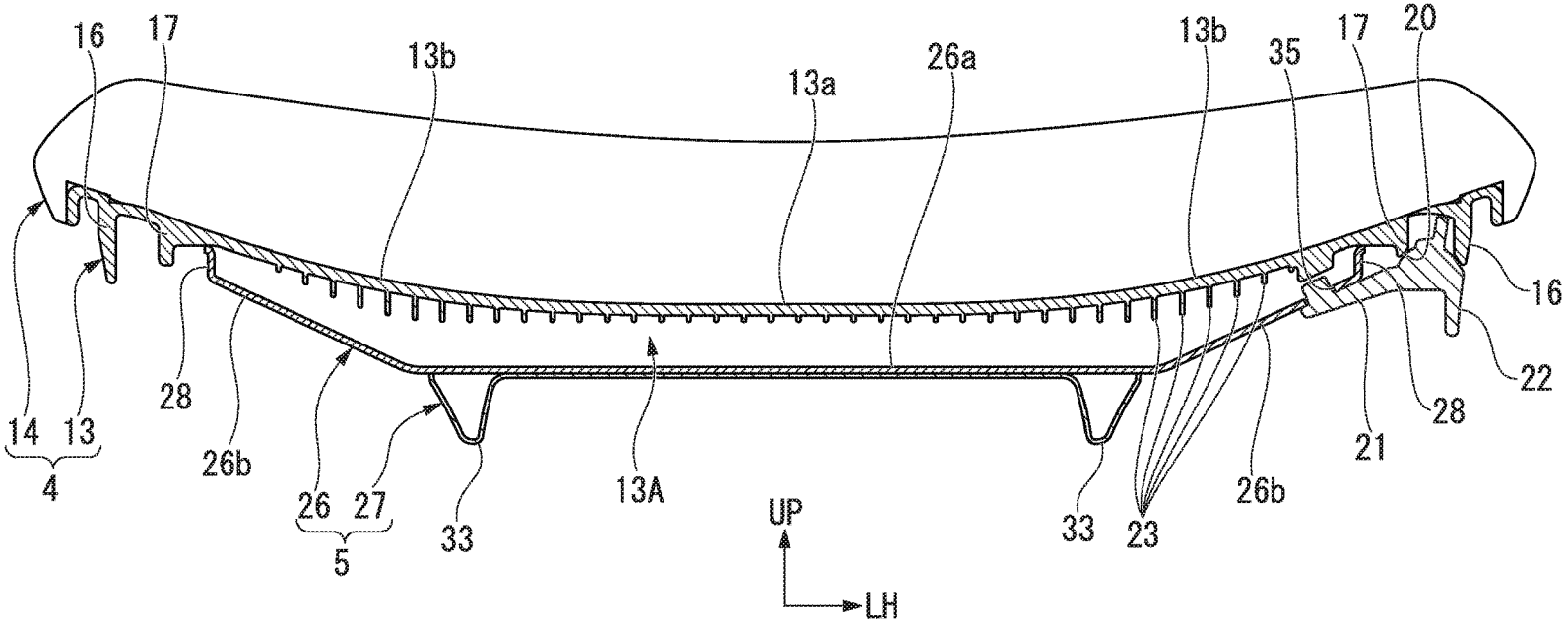
FIG. 7 is a sectional view corresponding to a cross section taken along line A-A of FIG. 6 of the seat body and seat receiving member of the chair in the first embodiment of the present invention.
Figure 8:
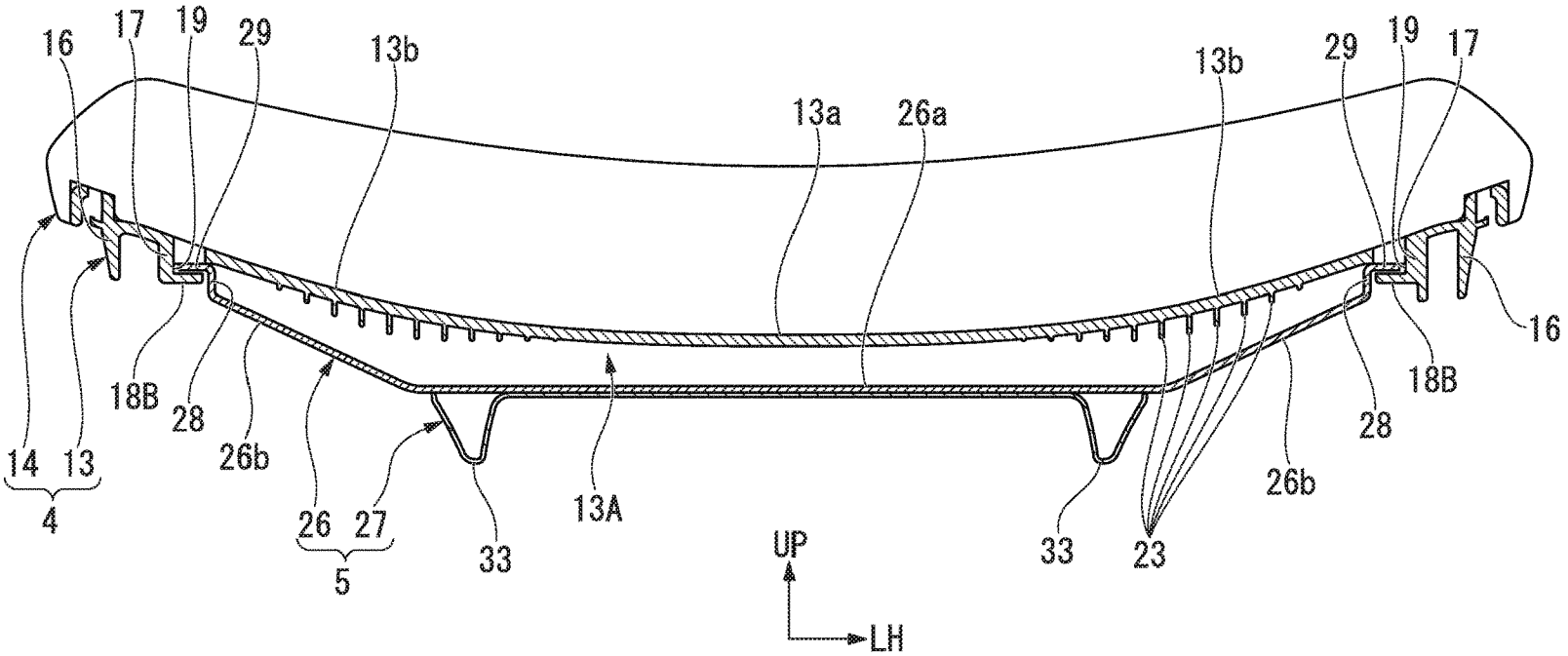
FIG. 8 is a sectional view corresponding to a cross section taken along line B-B of FIG. 6 of the seat body and seat receiving member of the chair in the first embodiment of the present invention.
Figure 9:
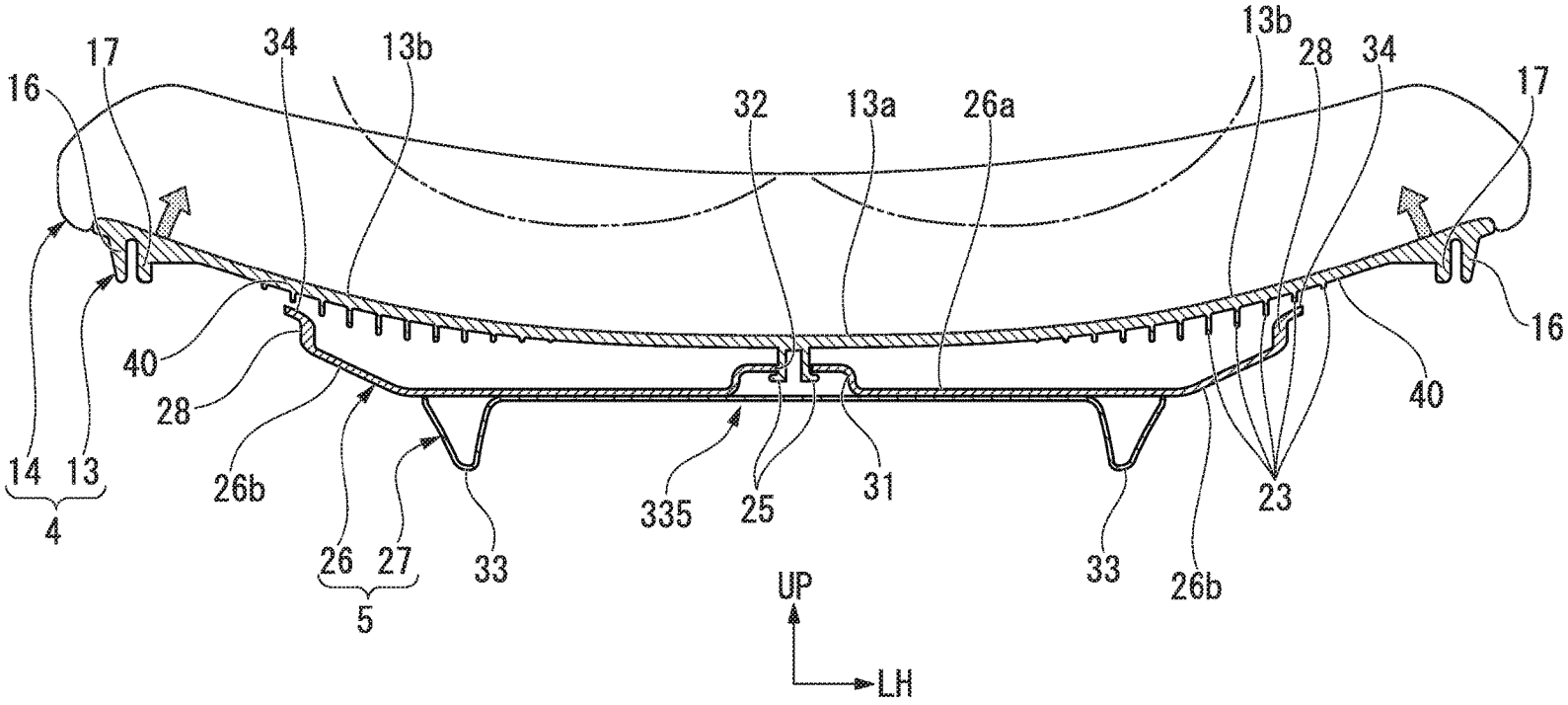
FIG. 9 is a sectional view corresponding to a cross section taken along line C-C of FIG. 6 of the seat body and seat receiving member of the chair in the first embodiment of the present invention.
Figure 10:
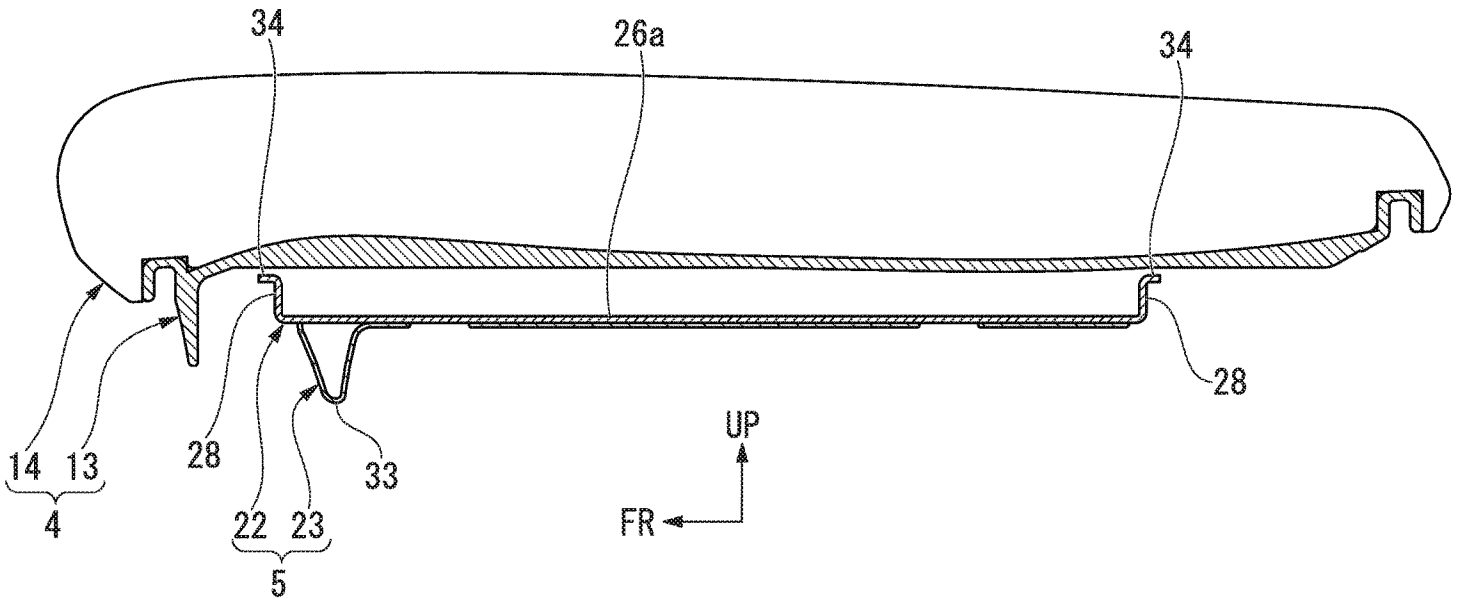
FIG. 10 is a sectional view corresponding to a cross section taken along line D-D of FIG. 6 of the seat body and seat receiving member of the chair in the first embodiment of the present invention.

Also, as shown in FIGS. 7 to 9, the seat plate 13 is formed such that a predetermined central range in a leftward/rightward direction becomes approximately horizontal in a state in which the chair 1 is correctly installed. Here, this region becoming approximately horizontal is referred to as a central region 13*a*. Also, both left and right sides of the central region 13*a* of the seat plate 13 are formed such that oblique regions 13*b* inclined upward with respect to the central region 13*a* are continuous with the central region 13*a*. Accordingly, the entire region of the seat plate 13 has a shape in which an approximately central portion in the leftward/rightward direction is slightly recessed in a concave shape.

At a circumferential edge of the seat plate 13 excluding a central region of a rear side of the seat plate 13, a continuous shield wall (outer circumferential wall) 16 doubling as a reinforcement rib protrudes downward. This shield wall 16 functions to hide a lower surface of the seat plate 13 from a lateral view, and to regulate excessive bending deformation of the entire region of the seat plate 13.

Support walls 17 protrude from lower surfaces of left and right lateral edges of the seat plate 13, and approach leftward and rightward inner sides in the vicinity of the shield wall 16 to extend in the forward/backward direction. Two inward flanges 18A and 18B protrude from an inner surface (surface facing the leftward/rightward inner side) of each support wall 17. As shown in FIG. 8, these inward flanges 18A and 18B define nearly U-shaped engaging grooves 19 that are open to the leftward/rightward inner side along with each support wall 17 and the lower surface of the seat plate 13 adjacent to this support wall 17.

As shown in FIGS. 3 and 6, one inward flange 18A protruding from each of the support walls 17 is disposed at a position close to the front portion of the seat plate 13 in the forward/backward direction, and the other inward flange 18B is disposed at a nearly central position of the seat plate 13 in the forward/backward direction. Also, as shown in FIG. 7, a region between the front and rear inward flanges 18A and 18B of the left support wall 17 is provided with a cutout part 20, and a tilting operation of a lock lever 21 for locking a front or rear position of the seat body 4 is allowed by the cutout part 20.

The lock lever 21 of this embodiment is integrally formed with a release operation knob 22 grasped by an operator, and is supported on a left lower surface of the seat plate 13 to be rotatable about an axis extending in the forward/backward direction along with the release operation knob 22. The lock lever 21 and the release operation knob 22 are biased in a locking direction in which a tip of the lock lever 21 is brought close to the lower surface of the seat plate 13 by a biasing spring (not illustrated), and is rotated in a unlocking direction by an operation that pulls up the release operation knob 22 to an upper direction.

Also, a plurality of ribs 23 extending in the forward/backward direction protrude from the lower surface of the seat plate 13 at substantially regular intervals. A height to which these ribs 23 protrude is set to be lower than that to which the shield wall 16 and the support walls 17 protrude from the lower surface of the seat plate 13. The ribs 23 are provided at almost part of the lower surface of the seat plate 13 except a predetermined range at lateral ends of the left and right oblique regions 13*b* and a part of the central region 13*a* within the lower surface of the seat plate 13. Also, as shown in FIG. 8, the ribs 23 formed in the left and right oblique regions 13*b* of the seat plate 13 are gradually reduced in height with the approach to the leftward and rightward ends. For this reason, rigidity of each of the oblique regions 13*b* is gradually reduced toward the leftward or rightward end.

In addition, a cylindrical boss part 24 protrudes from the lower surface of the seat plate 13 which is located close to a rear portion of the central region 13*a*. A lower end of the boss part 24 is integrally formed with locking flanges 25 protruding in the leftward and rightward directions. Functions of the boss part 24 and the locking flanges 25 will be described below.

On the other hand, the seat receiving member 5 is equipped with a base plate (seat receiving main body) 26 that is formed of a metal plate and directly supports the seat plate 13, and a lower plate (leg body fixing support) 27 that is interposed between the base plate 26 and the support base 3 and is formed of a synthetic resin. The lower plate 27 is placed on the upper surface of the support base 3. The base plate 26 is nearly horizontally fixed on the upper surface of the support base 3 by a fixing means (not illustrated) in a state in which the lower plate 27 is sandwiched between the base plate 26 and the support base 3.

Figure 12:
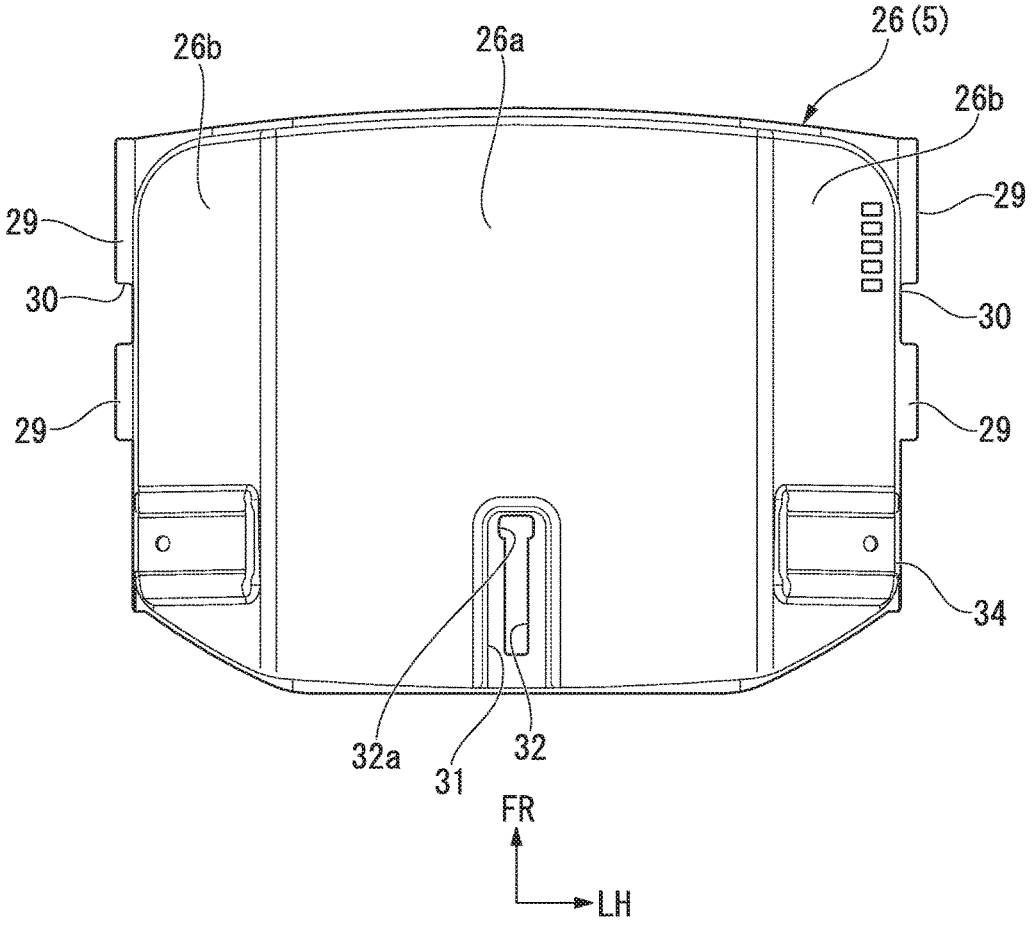
FIG. 12 is a bottom view in which some components of the seat receiving member of the chair in the first embodiment of the present invention are demounted.

FIG. 12 is a bottom view of the base plate 26 of the seat receiving member 5.

As shown in the same figure, the base plate 26 has a nearly rectangular shape in which two corners near a rear portion thereof are rounded in a top view. As shown in FIGS. 7 to 9, the base plate 26 is formed such that a predetermined range of the center thereof in the leftward/rightward direction becomes approximately horizontal when the chair 1 installed correctly. This region becoming approximately horizontal is referred to as a central region (leg body fixing plate part) 26*a*. Also, similar to the seat plate 13, both left and right sides of the central region 26*a* of the base plate 26 are formed such that a pair of left and right oblique regions (oblique plate parts) 26*b* inclined upward with respect to the central region 26*a* are continuous with the central region 26*a*. A standing wall (outer circumferential wall part) 28 erected upward is entirely provided on an outer circumferential end of the base plate 26. Outward flanges 29, which are protrusions inserted into and engaged with the engaging groove 19 adjacent to the seat plate 13, are projected at an upper end of the standing wall 28 located at left and right lateral sides of the base plate 26. That is, the base plate 26 is formed in a shallow tray shape as a whole.

Each of the left and right outward flanges 29 is provided in a range from an approximately central portion to a front end of the base plate 26 in the forward/backward direction. However, a part of each outward flange 29 is provided with an assembling cutout part 30 for assembling the seat plate 13 to the base plate 26.

When the seat plate 13 is assembled to the seat receiving member 5, the inward flanges 18B adjacent to the rear portion of the seat plate 13 are inserted into the cutout parts 30 of the outward flanges 29 from above. In this state, the seat receiving member 5 is moved forward, and thereby the left and right outward flanges 29 of the seat receiving member 5 are engaged into the left and right engaging grooves 19, respectively.

Here, as the nearly U-shaped engaging grooves 19 formed in both of the left and right edges of the seat plate 13 are engaged with the outward flanges 29 at both left and right sides of the seat receiving member 5, a region ranging from an approximately central portion to the vicinity of a front portion of the seat plate 13 in the forward/backward direction is regulated in upward/downward displacement by the seat receiving member 5. Thus, the region ranging from the approximately central portion to the vicinity of the front portion of the seat plate 13 in the forward/backward direction is hung from and supported on the seat receiving member 5 by the left and right lateral edges of the seat plate 13. In this embodiment, the outward flanges 29 at both of the left and right sides of the seat receiving member 5 constitute a constraining support part that regulates upward/downward displacement of the lateral edges of the seat plate 13 to support the seat plate 13, and the engaging grooves 19 at both of the left and right sides of the seat plate 13 constitute the supported part that is supported by the constraining support part for the seat receiving member 5.

On the other hand, portions of the left and right oblique regions 13*b* of the seat plate 13 located at a rear side from the engaging grooves 19 (inward flanges 18B) serve as warpage allowable parts 40 in which warpage deformation is allowed toward lateral ends of the seat plate 13 without the upward displacement being regulated by the seat receiving member 5.

Also, an upper end of the standing wall 28 at the outer circumferential end of the base plate 26 is formed with outward small flanges 34 that are bent in regions in which there are no outward flanges 29. Upper surfaces of the small flanges 34 are disposed opposite to the lower surface of the seat plate 13. In this embodiment, the upper surfaces of the small flanges 34 located at a rear side from the outward flanges 29 on the base plate 26 come into contact with the lower surface of the seat plate 13 (particularly, lower ends of the ribs 23 protruding from the lower surface of the seat plate 13) in a region at a rear side from the inward flanges 18B to constitute a downward displacement regulating surface that regulates displacement of the seat plate 13 in a downward direction of the region.

In FIGS. 2 and 6, a reference sign 35 indicates a plurality of fitting holes of the lock lever 21 which are formed in a left lateral edge of the base plate 26 which is adjacent to the front portion of the base plate 26 in the forward/backward direction, and a reference sign 36 indicates mounting parts for mounting the armrests 90 (see FIG. 1).

Figure 11:
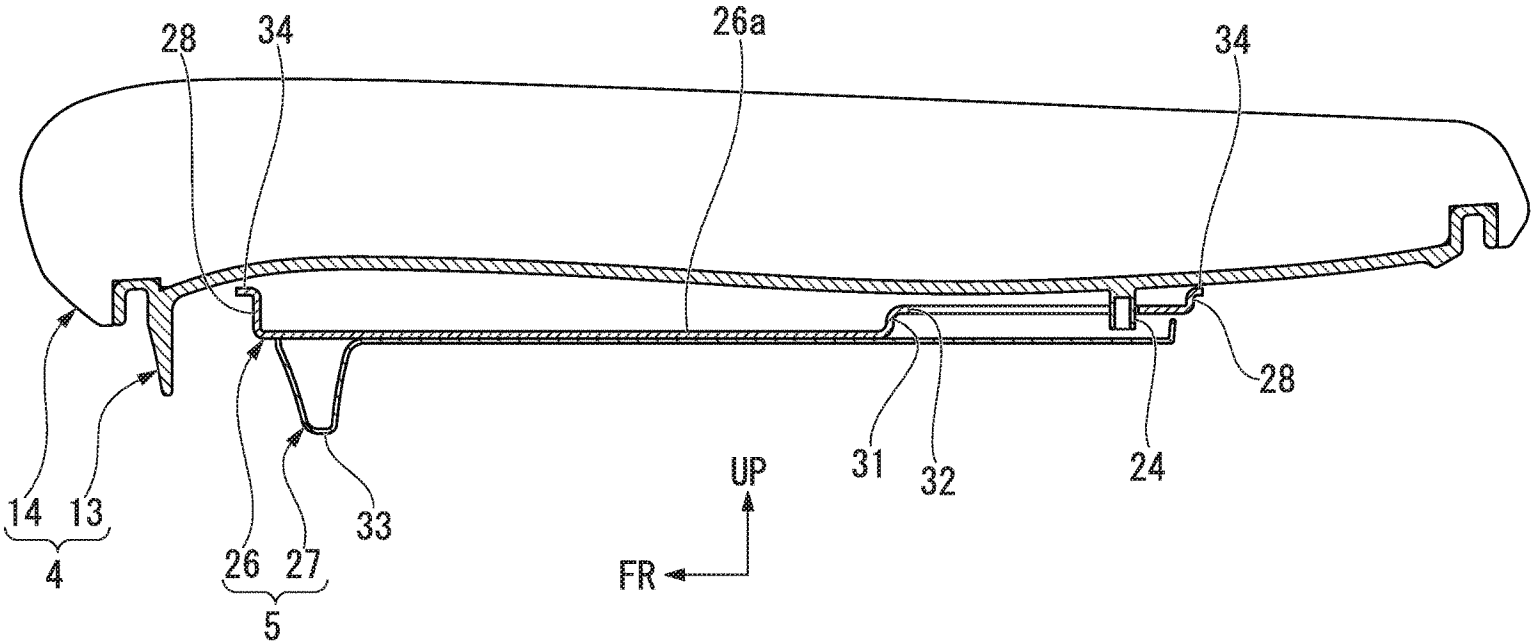
FIG. 11 is a sectional view corresponding to a cross section taken along line E-E of FIG. 6 of the seat body and seat receiving member of the chair in the first embodiment of the present invention.

Also, as shown in FIGS. 9, 11 and 12, a rear edge of the central region 26*a* of the base plate 26 located at an approximately central position in the leftward/rightward direction is provided with a recessed part 31 that is recessed upward in a concave shape, and a bottom of the recessed part 31 is formed with a slit 32 that extends in the forward/backward direction and has a predetermined length. The boss part 24 protruding from the lower surface of the seat plate 13 is slidably inserted into the slit 32. In the figures, a reference sign 32*a* indicates an enlarged width part which is provided at a front end of the slit 32 and into which the locking flanges 25 at the tip of the boss part 24 are inserted in assembly. When the boss part 24 protruding from the seat plate 13 is disposed in the slit 32 of the base plate 26, and when the locking flanges 25 at the tip of the boss part 24 are disposed under the recessed part 31, the lower surface of the seat plate 13 and the locking flanges 25 come into contact with the base plate 26, and thereby the upward/downward displacement of the seat plate 13 is regulated. In the embodiment, the boss part 24, the locking flanges 25, the slit 32, etc. constitute a displacement regulator 335 that regulates the upward/downward displacement of the seat plate 13 relative to the seat receiving member 5 in an approximately intermediate region between the warpage allowable parts 40 at the opposite sides of the seat plate 13.

When positions of the locking flanges 25 and the enlarged width part 32*a* in the displacement regulator 335 are matched in the forward/backward direction, positions of front spaces of the outward flanges 29 and positions of the front inward flanges 18A of the seat plate 13 are also matched in the forward/backward direction, and positions of the cutout parts 30 of the outward flanges 29 and positions of the rear inward flanges 18B of the seat plate 13 are also matched in the forward/backward direction.

In this state, the seat plate 13 and the seat receiving member 5 are caused to approach each other. Thereby, the locking flanges 25 of the displacement regulator 335 reach a lower side of the recessed part 31 through the enlarged width part 32*a*, and the inward flanges 18A and 18B reach lower sides of the respective outward flanges 29 through the front spaces and the cutout parts 30 of the outward flanges 29.

Afterwards, the seat plate 13 is moved backward relative to the seat receiving member 5. Thereby, the displacement regulator 335 is engaged with the recessed part 31 with upward displacement regulated, and the inward flanges 18A and 18B are engaged with the respective outward flanges 29 to disable upward/downward displacement.

Thereby, three points located at both left and right sides of the front portion of the seat plate 13 and a leftward/ rightward central portion of the rear portion of the seat plate 13 are regulated in upward/downward movement by the seat receiving member 5, and are supported on the seat receiving member 5 to be slidable back and forth.

On the other hand, as shown in FIG. 6, the lower plate 27 has an approximately square shape in which two corners adjacent to a front portion thereof are rounded in a top view (or in a bottom view), and is welded and fixed to the base plate 26 in a state in which it overlaps a lower surface of the central region of the base plate 26. At a front edge and left and right lateral edges of the lower plate 27, a reinforcement wall (stationary support projection) 33, which is bent downward in an approximately U-shaped cross section and is continuous in a U shape in a bottom view, is continuously provided. This reinforcement wall 33 increases rigidity of a circumferential edge of the central region 26*a* of the base plate 26. Also, when the seat receiving member 5 is mounted on the support base 3, the reinforcement wall 33 covers outsides of an upper front edge and both left and right lateral edges of the support base 3. Further, in a state in which the lower plate 27 overlaps the lower surface of the base plate 26, the lower plate 27 covers a lower side of the recessed part 31 adjacent to the rear edge of the base plate 26.

When the user who sits on this chair 1 adjusts the front or rear position of the seat body 4 for the support base 3 and the backrest part 6, the user pulls up the release operation knob 22 at a left lateral portion of the seat body 4 to release forward/backward lock of the seat body 4. In this state, the user adjusts the seat body 4 to a proper front or rear position with respect to the seat receiving member 5.

At this time, as the outward flanges 29 adjacent to the seat receiving member 5 relatively move (slide) in the engaging grooves 19 at the front lateral edges of the seat body 4, and as the boss part 24 projected from the rear lower surface of the seat body 4 relatively moves in the slit 32 at the rear edge of the seat receiving member 5, the forward/backward movement of the seat body 4 relative to the seat receiving member 5 is performed. In this way, after the front or rear position of the seat body 4 is adjusted to the proper position, when the user releases the grasp of the release operation knob 22, the lock lever 21 receives a force of the biasing spring to return to an initial position, and a coupling claw of the lock lever 21 is fitted into the fitting hole 35 corresponding to the left lateral portion of the seat receiving member 5. As a result, the front or rear position of the seat body 4 is fixed at the proper position.

When the user sits on the seat body 4 of the chair 1 in this state, a load of the user is applied to the seat plate 13 formed of the synthetic resin through the seat 14. In this way, when the load is applied to the seat plate 13 from above, this load is mainly supported at portions (a lower surface of the seat plate 13) corresponding to the engaging grooves 19 of the left and right lateral edges of the seat plate 13 by the left and right outward flanges 29 of the seat receiving member 5, as shown in FIG. 8. At this time, a region ranging from the vicinity of the forward/backward central portion to the vicinity of the front end of the seat plate 13 whose upward/downward displacement is constrained by the engagement of the engaging grooves 19 and the outward flanges 29 receives the load from above, and the central region 13*a* thereof is slightly bent and deformed downward. Also, when the load of the user at this time is applied to a region adjacent to the rear side from the engagement portions of the engaging grooves 19 of the seat plate 13 and the outward flanges 29 of the seat receiving member 5, the warpage allowable parts 40 located at both of the left and right edges of the rear side of the seat plate 13, at the rear side of which the upward displacement is not regulated by the seat receiving member 5, are warped and deformed upward as indicated by an arrow in FIG. 9. As a result, both of the left and right edges (warpage allowable parts 40) of the rear side of the seat plate 13 rise to approach left and right lateral portions of buttocks of the user, and are held such that the buttocks of the user are enclosed from the side.

Also, in the chair 1, the engaging grooves 19 of the left and right lateral edges of the seat plate 13 and the outward flanges 29 of the seat receiving member 5 are engaged in the region that ranges from the vicinity of the forward/backward central portion to the vicinity of the front end of the seat plate 13, and thereby the upward/downward displacement is constrained. For this reason, even when a seating posture of the user is changed or the load biased toward the seat body 4 is applied, it is possible to reliably prevent falling of the seat body 4 from the seat receiving member 5.

In this embodiment, the locking flanges 25 provided for the boss part 24 in the middle of the seat plate 13 are adapted to come in contact with an edge of the lower surface side of the slit 32 adjacent to the seat receiving member 5 in the vicinity of the rear edge of the seat plate 13. For this reason, a rise of the middle of the seat plate 13 in the vicinity of the rear edge of the seat plate 13 can also be reliably prevented by the displacement regulator that is made up of the boss part 24, the locking flanges 25, the slit 32, and so on. Also, in this embodiment, in comparison with the case in which the upward/downward displacement of the seat plate 13 is regulated only by the engagement of the left and right engaging grooves 19 of the seat plate 13 and the outward flanges 29 of the seat receiving member 5, a distance between the regions regulating the upward/downward displacement of the seat plate 13 becomes short, and thus unsteadiness of the seat plate 13 can be more effectively suppressed.

Alternatively, the boss part 24, the locking flanges 25, the slit 32, etc. that regulate the upward/downward displacement in the middle of the seat plate 13 in the vicinity of the rear edge of the seat plate 13 may also be omitted.

Also, in the case of the chair 1 of this embodiment, the seat receiving member 5 is provided with the small flanges 34 that face the lower surface of the seat plate 13 at the rear side from the engaging grooves 19. For this reason, although the load disproportionately acts on a portion of the seat plate 13 in the vicinity of the rear edge of the seat plate 13 due to a change in the seating posture of the user, partial sagging of the rear edge of the seat plate 13 can be suppressed by the small flanges 34. Particularly, in the case of this embodiment, since the small flanges 34 are provided at the upper end of the standing wall 28, a load of the seat plate 13 which causes the sagging can be more rigidly sustained.

Also, in this embodiment, the engaging grooves 19, which extend in the forward/backward direction to be open inward in the leftward/rightward direction, are provided at the left and right edges of the seat plate 13, and the outward flanges 29, which are the protrusions engaged with the engaging grooves 19, are provided at the left and right edges of the seat receiving member 5. A constraining support part for the seat plate 13 and a constrained support part for the seat receiving member 5 are formed by the engaging grooves 19 and the outward flanges 29. For this reason, there is an advantage that, as the outward flanges 29 are engaged with the engaging grooves 19 in the forward/backward direction, the constraining support part for the seat plate 13 and the constrained support part for the seat receiving member 5 can be easily assembled.

Further, in the case of this embodiment, the left and right outward flanges 29 of the seat receiving member 5 are inserted into and engaged with the left and right engaging grooves 19 of the seat plate 13, and a position of the seat plate 13 is made adjustable relative to the seat receiving member 5 via these engagement parts. Thus, when the seat plate 13 is adjusted to either the front or rear position, the upward/downward displacement of the seat plate 13 can be reliably regulated by the engagement of the engaging grooves 19 and the outward flanges 29.

Next, a constitution and function of the seat plate 13 in the chair 1 having the above constitution will be described in greater detail.

The left and right lower surfaces of the seat plate 13 are brought into contact with the upper surfaces of the outward flanges 29 of the seat receiving member 5 in a loadless state in which the user is not seated (see FIG. 8), and the seat plate 13 is separated from other regions of the seat receiving member 5. On the other hand, a leftward/rightward intermediate portion of the seat plate 13 is bent to be displaced downward in a load-bearing state in which the user is seated and a body pressure is applied, and lower ends of the ribs 23 are adequately brought into contact with the upper surfaces of the small flanges 34 of the seat receiving member 5. Further, when the seat plate 13 is bent, an inner circumference side thereof may be brought into contact with an upper surface of the seat receiving member 5 at an inner circumference side from the small flanges 34.

When the user sits forward on the seat body 4 and the load from the buttocks of the user is applied to the front portion of the seat plate 13, the front portion of the seat plate 13 is mainly displaced so as to sag downward. At this time, the inward flanges 18A and 18B are laterally engaged with each of the outward flanges 29 of the seat receiving member 5 from the outside. Thereby, although the seat plate 13 is sagged and the left and right lateral portions thereof are pulled inward, it is impossible for the engagement between the flanges to be released to cause the seat plate 13 to fall from the seat receiving member 5. Also, due to the engagement between the flanges, the upward displacement (warpage) at the opposite sides of the front portion of the seat plate 13 is suppressed, and thereby excessive hold of the buttocks of the user when sitting forward is suppressed.

On the other hand, when the user sits back on the seat body 4 and the load from the buttocks of the user is applied to the rear portion of the seat plate 13, the rear portion of the seat plate 13 is mainly displaced and sagged downward. At this time as well, the engagement between the flanges is not released, but the upward displacement (warpage) at the opposite sides of the rear portion of the seat plate 13 is allowed. Thereby, the buttocks can be held to be enclosed from the left and right sides, and a correct seating posture is supported when the user sits back.

Also, when the boss part 24 is engaged with the slit 32 to be able to slide back and forth and to be unable to be displaced up and down, the leftward/rightward intermediate portion of the rear portion of the seat plate 13 can be displaced downward relative to the seat receiving member 5 by a gap between the upper surface of the recessed part 31 and the lower surface of the seat plate 13. On the other hand, both of the rear left and right lateral portions of the seat plate 13 can be displaced downward to a relatively small extent by a gap between the upper surfaces of the small flanges 34 of the seat receiving member 5 and the lower surface of the seat plate 13 (the lower ends of the ribs 23 in FIG. 9).

Figure 13:
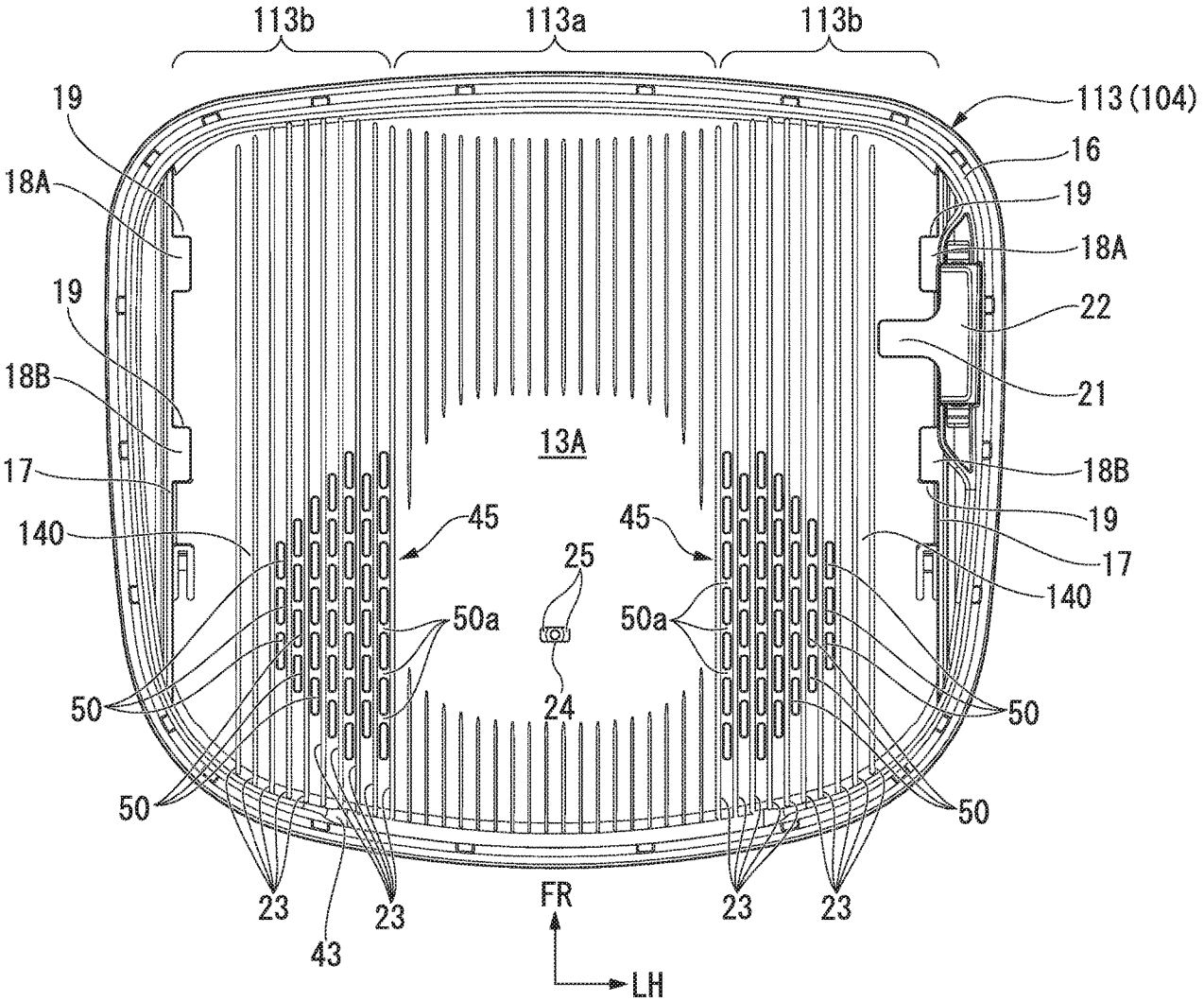
FIG. 13 is a bottom view in which some components of the seat receiving member of the chair in the first embodiment of the present invention are demounted.

Referring to FIGS. 7, 8 and 13, the seat plate 13 integrally has a seat plate main body 13A that is formed in a nearly square shape in a top view and is shaped of a shallow dish that bulges downward with a region located somewhat close to the front of the central portion set as a top part, the plurality of ribs 23 that are provided on a lower surface of the seat plate main body 13A to extend in the forward/backward direction and to be arranged left and right independently of one another, and the shield wall 16 (described above) that is vertically provided at an outer circumferential portion of the lower surface of the seat plate main body 13A and is disposed to surround the plurality of ribs 23.

The ribs 23 are formed such that tip edges thereof are arranged in the forward/backward direction and an amount of protrusion is increased toward left and right outer sides and is reduced at the outer sides. Since the seat plate 13 has the dish shape, the ribs 23 disappear in the vicinity of the front of the central portion of the seat plate main body 13A. The ribs 23 may be set not to disappear.

Referring to FIG. 6 together, the seat receiving member 5 extends throughout the width of a region in which the ribs 23 of the seat plate 13 are formed in the leftward/rightward direction, and is provided to cover a region from which front and rear portions of the region in which the ribs 23 are formed are excluded in the forward/backward direction.

The seat receiving member 5 covers most rib groups among the ribs 23, and thereby the reinforcement structures such as the ribs 23 are hardly visible from the outside. The ribs 23 extend in a direction (forward/backward direction) in which the seat receiving member 5 and the seat plate 13 move relatively. Thereby, although the seat plate 13 moves back and forth in a state in which the ribs 23 are in contact with the seat receiving member 5, the seat plate 13 can move smoothly without the ribs 23 being caught.

When the user is seated, the tip edges of the ribs 23 come in contact with front and rear upper surfaces of the small flanges 34 of the seat receiving member 5, and regulate excessive deformation of the seat plate 13. At this time, by adjusting positions, heights, etc. of the ribs 23 coming in contact with the seat receiving member 5, a bottom contact feeling of the sagged seat plate 13 and bendability of the seat plate 13 after the contact with the ribs 23 can be controlled.

The ribs 23 disappear because the amount of protrusion in the vicinity of the front and rear portions of the shield wall 16 is gradually reduced. The rear end of the shield wall 16 is formed with a cutout part 43 for avoiding the backrest support member 9. Rear ends of the ribs 23 face the inside of the cutout part 43. Further, the ends of the ribs 23 may be configured to be connected to the shield wall 16 in a region in which the ends of the ribs 23 extend to a terminal end of the seat plate 13 without disappearance and reach the shield wall 16.

The shield wall 16 is a member that makes it difficult to see the ribs 23 from the outside and is intended to inhibit the fingers of the user from entering the periphery of the support base 3, but the fingers of the user reaching the periphery of the support base 3 through the cutout part 43 in the vicinity of the backrest support frame 9 is also considered. However, in the present embodiment, the ribs 23 are disposed such that the rear ends of the plurality of ribs 23 face the inside of the cutout part 43, and thereby the entry of the fingers is suppressed even if the fingers reach the cutout part 43. In addition, the fingers touch the ribs 23, and the user becomes aware of this. Also, the cutout part 43 is formed at the rear portion of the shield wall 16 that serves as the frame of the entire seat plate 13, and thereby the bendability, particularly of the rear portion, of the entire seat plate 13 in the leftward/rightward direction is secured.

The seat plate 13 suppresses the bending in the direction (forward/backward direction) in which the plurality of ribs 23 extend, and secures sufficient rigidity to support the body of the user. On the other hand, the plurality of ribs 23 are put into a mutually independent state (in other words, a state in which a groove extending in the forward/backward direction is formed between the neighboring ribs 23) without being connected by transverse ribs extending left and right. Thereby, the seat plate 13 is configured to be relatively easily bent in directions (leftward and rightward directions) in which the ribs 23 are arranged. Strength and rigidity of the entire seat plate 13 are properly secured by the frame-like shield wall 16.

As described above, in the structure of the chair baseplate in the above embodiment, the seat plate 13 supported on the leg body 2 has the plurality of ribs 23 that are formed on the lower surface of the seat plate main body 13A to extend in the forward/backward direction and are arranged left and right independently of one another, and the shield wall 16 that is formed at the outer circumferential portion of the lower surface of the seat plate main body 13A to surround the plurality of ribs 23.

According to this constitution, the bending in the direction in which the ribs 23 extend in the seat plate 13 is suppressed by the plurality of ribs 23, and a sense of rigidity of the seat body 4 is secured while the plurality of ribs 23 are put into an unconnected state in which they are independent of one another. Thereby, it is possible to easily bend the seat plate 13 in the directions (leftward and rightward directions) in which the plurality of ribs 23 are arranged. Due to the bending of the seat plate 13, it is possible to hold the body of the user to be enclosed from the leftward and rightward directions, and support the seating posture. The strength and rigidity of the entire seat plate 13 can be properly secured by the shield wall 16.

In the structure of the chair baseplate, the seat receiving member 5 supporting the seat plate 13 on the leg body 2 is provided to cover at least some of the rib groups of the plurality of ribs 23. Also, before the load corresponding to the body pressure of the user is applied to the seat plate 13, the seat receiving member 5 is separated from the tip edges of the ribs 23. In the state in which the load is applied, the seat receiving member 5 comes in contact with the tip edges of the ribs 23. As a result, without providing a separate cover, the reinforcement structures such as the ribs 23 are hardly visible from the outside by the seat receiving member 5, and it is possible to improve an appearance while reducing costs.

Also, when the user is seated, the tip edges of the ribs 23 are brought into contact with the seat receiving member 5 by the body pressure of the user. Thereby, the excessive deformation of the seat plate 13 can be suppressed, and the bending of the seat plate 13 can be controlled by setting of the ribs 23 coming in contact with the seat receiving member 5.

In the structure of the chair baseplate, the seat plate 13 is supported on the seat receiving member 5 to be movable in the extending direction of the ribs 23. Thereby, when the seat plate 13 is moved, although the ribs 23 abut the seat receiving member 5, it is possible to smoothly move the seat plate 13 along the ribs 23.

The chair 1 according to the present invention is equipped with the leg body 2, the seat receiving member 5 supported on the leg body 2, and the seat plate 13 supported on the seat receiving member 5. Also, the seat plate 13 has the plurality of ribs 23 that are formed on the lower surface of the seat plate main body 13A to extend in the forward/backward direction and are arranged left and right independently of one another, and the shield wall 16 that is formed at the outer circumferential portion of the lower surface of the seat plate main body 13A to surround the plurality of ribs 23. Further, the cutout part 43 avoiding the backrest support frame 9 is formed at the rear portion of the shield wall 16, and the rear ends of at least some of the rib groups of the plurality of ribs 23 face the cutout part 43.

According to this constitution, the bending in the extending direction of the ribs 23 in the seat plate 13 is suppressed by the plurality of ribs 23, and the sense of rigidity of the seat body 4 is secured while the plurality of ribs 23 are put into the unconnected state in which they are independent of one another. Thereby, it is possible to easily bend the seat plate 13 in the directions (leftward and rightward directions) in which the plurality of ribs 23 are arranged. Due to the bending of the seat plate 13, it is possible to hold the body of the user to be enclosed from the leftward and rightward directions, and support the seating posture. The strength and rigidity of the entire seat plate 13 can be properly secured by the outer circumferential wall 42, and the leftward/rightward bendability can also be secured by the cutout part 43.

Also, the cutout part 43 is formed at the rear portion of the shield wall 16 that serves as the frame of the entire seat plate 13, and thereby the leftward/rightward bendability, particularly of the rear portion, of the entire seat plate 13 is improved. The rear ends of the plurality of ribs 23 are made to face the cutout part 43, and thereby the fingers of the user can be inhibited from entering the cutout part 43.

Next, a second embodiment shown in FIG. 13 will be described. In each embodiment described below, the same reference sign is given to parts in common with the first embodiment, and duplicate description thereof will be omitted.

FIG. 13 is a bottom view of a portion of a seat plate 113 in the seat body 104. A chair of this embodiment is only different from that of the first embodiment in regard to a structure of the seat plate 113, and the other portions are the same as in the first embodiment.

Like the first embodiment, engaging grooves 19 are provided in both left and right edges of the seat plate 113, and a structure for promoting bending is provided for warpage allowable parts 140 (oblique regions 113*b*) at a rear side from the engaging grooves 119 of the left and right edges of the seat plate 113. Like the first embodiment, a plurality of ribs 23 extending outward in a forward/backward direction are provided on a lower surface of the seat plate 113 at regular intervals. Portions with no ribs 23 are provided at lateral edges of the warpage allowable parts 140 (oblique regions 113*b*) and a part of a region (central region 113*a*) between the left and right warpage allowable parts 140.

The warpage allowable parts 140 (oblique regions 113*b*) of the seat plate 113 are each provided with the plurality of ribs 23 and plurality of thinning holes 50 that are intermittently formed between the neighboring ribs 23 and 23 and act as bending promoters. In the case of this embodiment, each of the thinning holes 50 is formed in an extending direction of the ribs 23 in a long hole shape that extends in the forward/backward direction, and vertically passes through the seat plate 13. Also, the plurality of thinning holes 50 are formed to be arranged in a zigzag shape in a top view.

The warpage allowable parts 140 of the seat plate 113 are each provided with the plurality of ribs 23 running in the forward/backward direction and the thinning holes 50 disposed between the neighboring ribs 23 and 23. As a result, forward/backward rigidity is kept high by the ribs 23, and rigidity in leftward and rightward directions is weakened by the thinning holes 50. The warpage allowable parts 140 of this embodiment employ a bending promotion structure having directivity reducing flexural rigidity in the leftward and rightwards while maintaining the forward/backward rigidity of the seat plate 113.

In the chair of this embodiment, the plurality of thinning holes 50 are provided for the warpage allowable parts 140 of the seat plate 113, and thereby bending deformation of the warpage allowable parts 140 in a surface direction is made easy. For this reason, when the load of the user acts on regions of the seat plate 113 which are located at a rear side from the engaging grooves 19, warpage deformation of the warpage allowable parts 140 can be more reliably obtained.

Particularly, in the chair of this embodiment, the warpage allowable parts 140 of the seat plate 113 are each provided with the plurality of ribs 23 that extend out in the forward/backward direction and the plurality of thinning holes 50 that are intermittently formed in a general surface between the neighboring ribs 23 and 23. For this reason, when the load of the user acts on the regions of the seat plate 113 which are located at a rear side from the engaging grooves 19, warpage deformation in the leftward and rightward directions can be promoted without incurring great bending deformation of the warpage allowable parts 140 in the forward/backward direction. Therefore, in the chair of this embodiment, it is possible to further improve seating stability of the seat body.

That is, in the above constitution, when the seat user sits on the seat body 4 and the load from the buttocks is applied to the rear portion of the seat plate 13, the rear portion of the seat plate 13 is mainly displaced and sagged downward, and rear left and right lateral portions of the seat plate 13 are deformed to be warped back upward. At this time easily deformable parts 45 depending on openings of the thinning holes 50 are provided at both rear left and right sides of the seat plate 13, and the deformation occurs easily.

In the easily deformable parts 45 of FIG. 13, the plurality of thinning holes 50 are formed to be arranged in a zigzag shape. Thereby, installation parts 50*a* between ends of the thinning holes 50 are not continuous in directions in which the ribs 23 are arranged, and the easily deformable parts 45 can be expanded and contracted in the directions (leftward and rightward directions) in which the ribs 23 are arranged. Left and right inward displacement is regulated at the opposite lateral portions of the seat plate 13 by engagement with the seat receiving member 5, but the easily deformable parts 45 can be expanded and contracted in the leftward and rightward directions. Thereby, the rear portion of the seat plate 13 is easily sagged, and the rear portion of the seat plate 13 is easily warped back upward at both left and right sides thereof.

Thereby, the rear portion of the seat plate 13 is smoothly bent along the buttocks of the user, and can comfortably support the buttocks of the user. Since the forward/backward rigidity of the seat plate 13 is secured by the plurality of ribs 23 extending back and forth, femoral regions of the user supported on a front portion of the seat body can be steadily supported by suppressing the bending of the seat plate 13, and the sense of rigidity of the seat plate 13 can be obtained.

The easily deformable parts 45 may include at least one of thinned parts or groove parts, folded parts or bellows parts, and so on, in addition to the through-holes.

Also, instead of a backrest main body 10 configured to tightly provide a mesh fabric for a backrest frame, a backrest having a baseplate similar to the seat plate 13 may be employed. The present invention may be applied to various load support members such as a lumbar support and a headrest in the chair in addition to the seat body and the backrest.

Figure 14:
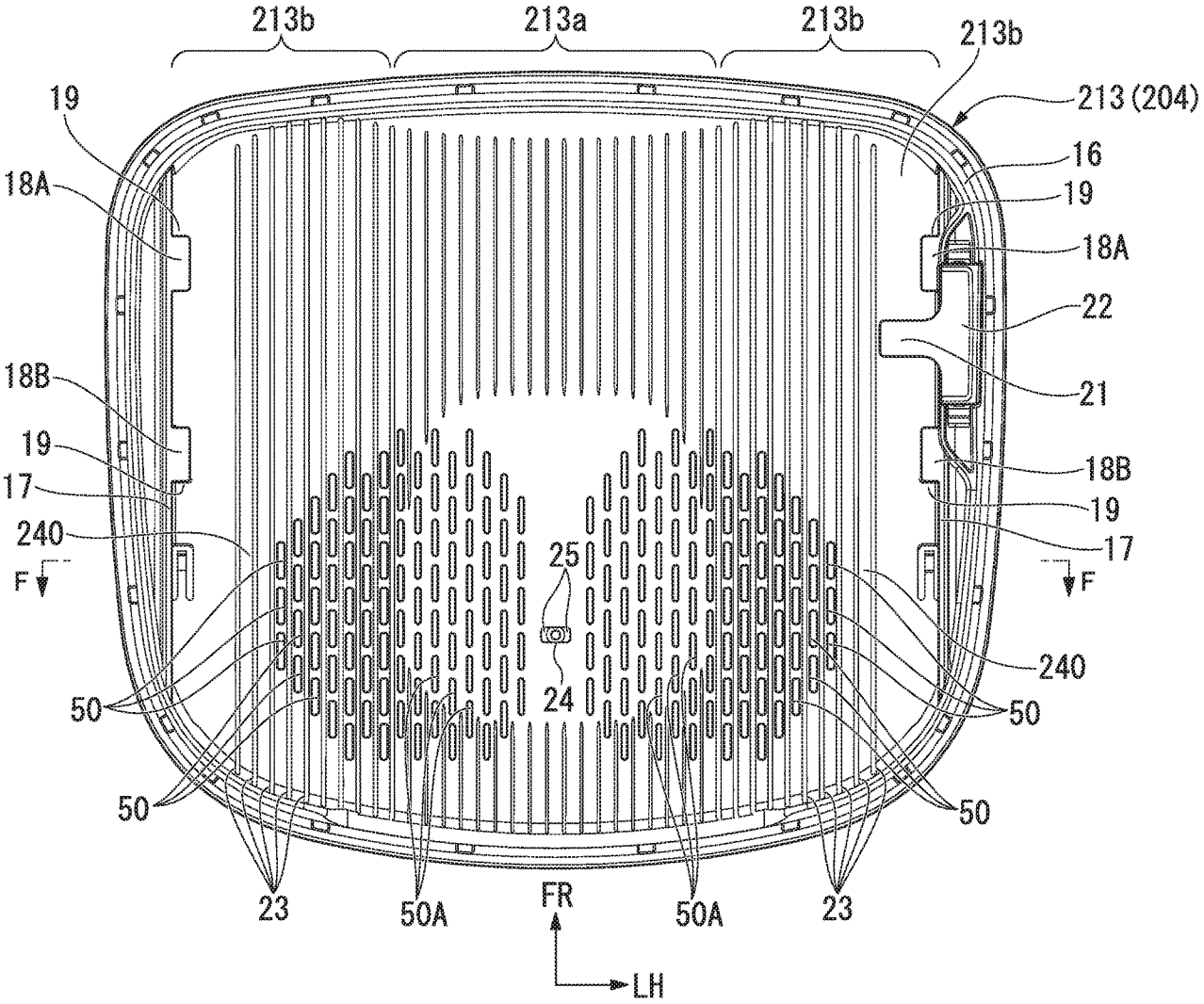
FIG. 14 is a bottom view of a seat plate of a chair in a third embodiment of the present invention.
Figure 15:
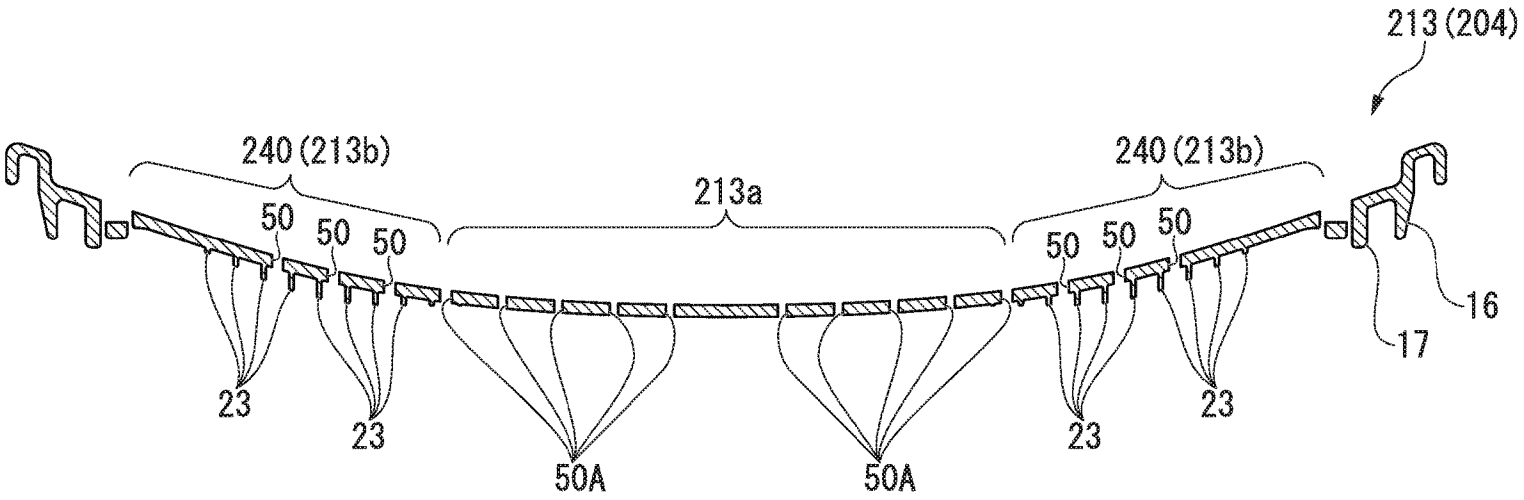
FIG. 15 is a bottom view is a sectional view corresponding to a cross section taken along line F-F of FIG. 14 of the seat plate of the chair in the third embodiment of the present invention.

FIGS. 14 and 15 are bottom and sectional views of a portion of a seat plate 113 in a seat body 204 illustrating a third embodiment.

A chair of this embodiment is the same as that of the second embodiment in regard to a fundamental constitution, and is slightly different from that of the second embodiment in regard to the numbers and positions of thinning holes 50 and 50A formed in the seat body 204.

That is, in the seat body 104 of the second embodiment, the thinning holes 50 are formed only between the neighboring ribs 23 and 23 of the left and right oblique regions 113*b* in rear regions of the seat plate 113 which are located at the rear of the engaging grooves 19. However, in the seat body 204 of the third embodiment, a plurality of thinning holes 50 are formed in a general surface between the neighboring ribs 23 and 23 of left and right oblique regions 313*b* in rear regions of a seat plate 213 which are located at the rear of engaging grooves 19, and a plurality of thinning holes 50A are also formed in parts of left and right lateral portions of the central region 213*a*. Some of the thinning holes 50A provided in the central region 213*a* are disposed between the neighboring ribs 23 and 23 at the portions at which the ribs 23 are located, but most of the remainder are disposed in a region in which the ribs 23 are located.

The thinning holes 50A of the central region 213*a* are formed in long hole shapes like the thinning holes 50 of the oblique regions 213*b*, but widths thereof are set to be narrower than those of the thinning holes 50 of the oblique regions 213*b*. Also, the plurality of thinning holes 50A of the central region 213*a* are intermittently disposed in a forward/backward direction like the thinning holes 50 of the oblique regions 213*b*.

The chair of the third embodiment can obtain the same basic effects as that of the second embodiment. However, since the plurality of thinning holes 50A are provided to cross a part of the central region 213*a* of the seat plate 213, warpage deformation of the warpage allowable parts 240 when the user sits on the seat body 204 can be more reliably made natural.

The present invention is not limited to the above embodiments, and various changes in design are possible without departing from the gist of the present invention. For example, each of the above embodiments has the structure in which, as the plurality of thinning holes are formed in the warpage allowable parts at the rear edge of the seat plate, the bending deformation of the warpage allowable parts in the surface direction becomes easy. However, in the warpage allowable parts, by partly reducing a thickness of the seat plate or reducing a height of the rib, the bending deformation of the warpage allowable parts in the surface direction can be made easy.

Also, when the thinning holes are formed in the seat plate as in each of the above embodiments, positions, length, intervals, etc. of the thinning holes can be adequately selected in view of a balance between the bendability (flexibility) and the strength. Also, in the above embodiments, the engaging grooves that are open inward in the leftward and rightward directions are formed in the opposite edges of the seat plate. However, the engaging grooves may be formed in the opposite edges of the seat plate to be open outward in the leftward and rightward directions. Further, the engaging grooves may be adapted to be provided for the seat receiving member.

INDUSTRIAL APPLICABILITY

According to the present invention, it is possible to further improve the seating stability of the seat body while preventing the falling of the seat plate of the chair. Also, the chair baseplate can be easily bent in a specific direction while securing a sense of rigidity of the chair baseplate.

REFERENCE SIGNS LIST

1: chair; 2: leg assembly; 4, 104, 204: seat body; 5: seat receiving member (seat receiving structure, baseplate receiving structure); 13, 113, 213: seat plate (chair baseplate); 13A: seat plate main body; 16: shield wall (outer circumferential wall); 19: engaging groove (supported part); 23: rib (protrusion); 24: boss part (displacement regulator); 25: locking flange (displacement regulator); 29: outward flange (protrusion, constraining support part); 34: small flange (downward displacement regulating surface); 40: warpage allowable part; 43: cutout part; 45: easily deformable part; 50: thinning hole (bending promoter); 140, 240: warpage allowable part; 300: leg body; 335: displacement regulator

The invention claimed is:

1. A chair in which a seat plate forming a frame part of a seat body is supported on a leg assembly via a seat receiving member, wherein the seat receiving member includes constraining support parts that supports left and right lateral edges of the seat plate and regulates upward/downward displacement of the left and right lateral edges of the seat plate, each of the left and right lateral edges of the seat plate includes a supported part that is supported by the constraining support parts, first portions of the left and right lateral edges of the seat plate, the first portions being from an approximately central portion to a front portion of the seat plate in the forward/backward direction, is regulated in the upward/downward displacement by engagement parts between the constraining support parts and the supported parts, second portions of the left and right lateral edges of the seat plate, the second portions being from the approximately central portion to a back portion of the seat plate in the forward/backward direction, serve as warpage allowable parts in which the upward/downward displacement is allowed, one of the constraining support part and the supported part is formed by an engaging groove that extends in the forward/backward direction and is open to either a leftward/rightward direction, and the other of the constraining support part and the supported part is formed by a protrusion engaged with the engaging groove, and the engaging groove and the protrusion are configured to be slidable in the forward/backward direction, and a position of the seat plate is made adjustable relative to the seat receiving member via the engaging groove and the protrusion in the forward/backward direction.

2. The chair according to claim 1, wherein a displacement regulator by which the upward/downward displacement is regulated between the seat plate and the seat receiving member is provided in an approximately intermediate region between the warpage allowable parts of the seat plate.

3. The chair according to claim 1, wherein the seat receiving member includes downward displacement regulating surfaces that are disposed to be able to come in contact with lower surfaces in regions of the seat plate which are located at a rear side from the supported parts.

4. The chair according to claim 1, wherein the warpage allowable parts of the seat plate include a bending promotion structure that facilitates bending deformation in a surface direction.

5. The chair according to claim 4, wherein a flexural rigidity of the bending promotion structure in the leftward/rightward direction is greater than that of the forward/backward direction.

6. The chair according to claim 5, wherein the bending promotion structure includes a plurality of ribs that are provided for the seat plate in the forward/backward direction, and a plurality of holes that are intermittently provided in a general surface between the plurality of ribs adjacent to each other of the seat plate.

7. The chair according to claim 1, wherein the seat plate supported in a place of the chair has:

a plurality of ribs that are formed in a reverse side of a seat plate main body which is an opposite side of an user, extend in directions intersecting the leftward/rightward direction, and are arranged in the leftward/rightward direction independently of one another; and an outer circumferential wall that is formed at an outer circumferential portion of the reverse side of the seat plate main body and surrounds the plurality of ribs.

8. The chair according to claim 7, wherein the seat plate has deformable parts in which a bending promoter is formed in such a manner to avoid the plurality of ribs in the seat plate main body.

9. The chair according to claim 7, wherein:

the chair includes the seat receiving member configured to support the seat plate in the place of the chair; and the seat receiving member is provided to cover at least some rib groups of the plurality of ribs, is separated from tip edges of the before a load corresponding to a body pressure of the user is applied to the seat plate, and comes in contact with the tip edges of the ribs when a load is applied.

10. The chair according to claim 9, wherein the seat plate is supported on the seat receiving member to be movable in a direction in which the plurality of ribs extend.

11. The chair according to claim 1, wherein the seat plate has a plurality of ribs that are formed on a lower surface of a seat plate main body to extend in a forward/backward direction, and are arranged left and right independently of one another, and an outer circumferential wall that is formed at an outer circumferential portion of the lower surface of the seat plate main body to surround the plurality of ribs;

a rear portion of the outer circumferential wall is formed with a cutout part that avoids a backrest support member; and rear ends of at least some rib groups of the plurality of ribs face the cutout part.

12. The chair according to claim 1, wherein the warpage allowable parts are located at the rear side of all the engagement parts between the constraining support parts and the supported parts.

* * * * *